US011466967B2

(12) United States Patent
Babcock

(10) Patent No.: US 11,466,967 B2
(45) Date of Patent: Oct. 11, 2022

(54) ADJUSTABLE BRACKET FOR SHOOTING TARGETS

(71) Applicant: Alex Babcock, Peoria, AZ (US)

(72) Inventor: Alex Babcock, Peoria, AZ (US)

( * ) Notice: Subject to any disclaimer, the term of this patent is extended or adjusted under 35 U.S.C. 154(b) by 0 days.

(21) Appl. No.: 17/076,059

(22) Filed: Oct. 21, 2020

(65) Prior Publication Data

US 2021/0033373 A1 Feb. 4, 2021

Related U.S. Application Data

(63) Continuation-in-part of application No. 16/748,915, filed on Jan. 22, 2020, now Pat. No. 11,041,699, which is a continuation of application No. 16/027,348, filed on Jul. 4, 2018, now Pat. No. 10,634,464.

(60) Provisional application No. 62/925,091, filed on Oct. 23, 2019, provisional application No. 62/528,751, filed on Jul. 5, 2017.

(51) Int. Cl.
*F41J 1/10* (2006.01)
*F41J 7/04* (2006.01)

(52) U.S. Cl.
CPC .. *F41J 1/10* (2013.01); *F41J 7/04* (2013.01)

(58) Field of Classification Search
CPC ..... F41J 1/10
USPC ..... 248/125.1, 295.11, 314
See application file for complete search history.

(56) References Cited

U.S. PATENT DOCUMENTS 1,716,054 A 6/1929 Heimann
4,029,318 A 6/1977 Boss
4,480,403 A * 11/1984 Williams ..... A01G 17/14 47/42
5,181,335 A * 1/1993 Todd ..... G09F 7/18 248/125.1
6,726,208 B2 * 4/2004 Wilkus ..... F41J 1/10 248/523
7,427,069 B2 * 9/2008 Bateman ..... F41J 1/10 273/406
7,997,547 B1 * 8/2011 Maus ..... E01F 9/688 248/219.3
8,622,394 B2 * 1/2014 Larue ..... F41J 1/10 273/407
9,282,752 B1 3/2016 Wylie
9,927,214 B2 3/2018 Cote
10,001,350 B2 6/2018 Pearcey
2008/0210831 A1 9/2008 Considine
2013/0328268 A1 * 12/2013 Eggiman ..... F41J 5/205 273/378
2015/0330747 A1 11/2015 Ferrell
2015/0330748 A1 11/2015 Anzalone
(Continued)

OTHER PUBLICATIONS

Jul. 5, 2017, U.S. Appl. No. 62/528,751, Provisional Utility, Expired (Jul. 5, 2018).

(Continued)

*Primary Examiner* — Laura Davison

(74) *Attorney, Agent, or Firm* — Law Offices of Lisa & Lesko, LLC; Justin Lesko, Esq.

(57) ABSTRACT

Systems and methods are disclosed for a shooting target mounting bracket with improved portability, versatility, and safety over existing devices. The mounting bracket is easily adjustable for height, compactable for transportation, and compatible with existing target posts and existing target shapes.

3 Claims, 38 Drawing Sheets

(56) References Cited

U.S. PATENT DOCUMENTS

| | | | | |
|---|---|---|---|---|
| 2018/0087881 | A1* | 3/2018 | Bickel | F41J 5/18 |
| 2018/0216920 | A1* | 8/2018 | Allison | F41J 1/10 |

OTHER PUBLICATIONS

Jul. 4, 2018, U.S. Appl. No. 16/027,348, Non-Provisional Utility, U.S. Pat. No. 10,634,464 (Apr. 28, 2020).
Oct. 23, 2019, U.S. Appl. No. 62/925,091, Provisional Utility, Expired (Oct. 23, 2020).
Jan. 22, 2020, U.S. Appl. No. 16/748,915, Continuation of U.S. Appl. No. 16/027,348, Pending.
U.S. Pat. No. 4,029,318—Boss, Jun. 1977, U.S. Appl. No. 16/027,348.
U.S. Pat. No. 1,716,054—Heimann, Jun. 192, U.S. Appl. No. 16/027,348.
U.S. Pub. 2015/0330747—Ferrell, Nov. 2015, U.S. Appl. No. 16/027,348.
G.L. Huyett Catalog, Positive Lock Pins, p. 71, 2015, U.S. Appl. No. 16/748,915.
Drawing, JABs Extreme Steel Targets (Undated), downloaded on or before Jun. 28, 2017.
Photograph, MGM Target (Undated), downloaded on or before Jun. 28, 2017.
Drawing, IPSC Target (Undated), downloaded on or before Jun. 28, 2017.
Specification Sheet, "Hollow Tread Wheel with Polypropylene Spoked Rim," McMaster-Carr Part No. 29635T31 (Jun. 9, 2017).
Specification Sheet, "Aluminum-Handle Push-Button Quick-Release Pin," McMaster-Carr Part No. 90985A319 (Copyright 2012).
Specification Sheet, "18-8 Stainless Steel Wire Rope Lanyard," McMaster-Carr Part No. 30345T524 (Undated), downloaded on or before Jun. 28, 2017.
Specification Sheet, "18-8 Stainless Steel Wire Rope Lanyard," McMaster-Carr Part No. 30345T521 (Undated), downloaded on or before Jun. 28, 2017.
Specification Sheet, "High-Load Oil-Embedded Thrust Bearing," McMaster-Carr Part No. 2879T3 (Copyright 2015).
Specification Sheet, "Thin Nylon-Insert Locknut," McMaster-Carr Part No. 94945A218 (Copyright 2015).
"Aluminum Pro Mechanic Bike Repair Stand Foldable Bicycle Workstand Lightweight & Portable," (Undated), downloaded from https://www.roadbikeoutlet.com/conquer-portable-aluminum-mechanic-bike-repair-stand-bicycle-workstand.html?utm_source=vilano&utm_campaign=buynow on Jul. 23, 2018.
"Dueling Tree," (captured Apr. 11, 2014), downloaded from http://steelplinkers.com/DuelingTree.html on May 2, 2019.
Specification Sheet, "Alloy Steel Socket Head Cap Screw," McMaster-Carr Part No. 90044A165 (Copyright 2013).
Specification Sheet, "Hex Nut," McMaster-Carr Part No. 90499A033 (Copyright 2015).
Specification Sheet, "Hex L-Key," McMaster-Carr Part No. 7122A26 (Undated), downloaded on or before Oct. 23, 2019.
Specification Sheet, "T-Bolt," McMaster-Carr Part No. 91285A119 (Copyright 2020).
Specification Sheet, "Alloy Steel Socket Head Cap Screw," McMaster-Carr Part No. 91251A624 (Copyright 2013).
Specification Sheet, "High-Strength Steel Nylon-Insert Locknut," McMaster-Carr Part No. 97135A418 (Copyright 2019).
Drawings, "JABs Extreme Steel Targets," "IBC-C Zone target with 2-4 bracket and base," and "LET 10" Circle Wood Stand Static Steel Target, (Undated), downloaded on or before Oct. 18, 2020.
Non-Final Office Action in U.S. Appl. No. 16/027,348, (dated May 7, 2019).
Response to Non-Final Office Action in U.S. Appl. No. 16/027,348 (dated Jul. 26, 2019).
Final Office Action in U.S. Appl. No. 16/027,348, (dated Oct. 2, 2019).
Response to Final Office Action in U.S. Appl. No. 16/027,348 (dated Oct. 10, 2019).
Notice of Allowance in U.S. Appl. No. 16/027,348 (dated Oct. 28, 2019).
Non-Final Office Action in U.S. Appl. No. 16/748,915, (dated Feb. 12, 2021).
G.L. Huyett Catalog, "Positive Lock Pins," p. 71 (2015).

* cited by examiner

ADJUSTABLE BRACKET FOR SHOOTING TARGETS

CROSS REFERENCE TO RELATED APPLICATIONS

This application is a continuation-in-part of Provisional Application No. 62/925,091, Filed Oct. 23, 2019, which is herein incorporated by reference. This application is also a continuation-in-part of application Ser. No. 16/748,915 (pending), Filed Jan. 22, 2020, which is a continuation of application Ser. No. 16/027,348, Filed Jul. 4, 2018 (now U.S. Pat. No. 10,634,464), which claims priority to Provisional Application No. 62/528,751, Filed Jul. 5, 2017, all of which are herein incorporated by reference.

BACKGROUND OF THE INVENTION

1. Field of the Invention

This application relates to and describes a shooting target bracket with improved portability, safety, and adjustability over existing devices. In addition, the bracket allows for high quality steel targets to be easily adapted to existing wood post target products on the market. Currently, adequate products do not exist that allow for high quality, high strength steel target silhouettes to be fastened to simple wood post target stands. Unlike existing targets, Applicant's bracket provides a system that is compacted during transportation, yet easy to set up with a safe deflection angle, even when constructed from heavy, high-quality steel parts. It also allows for steel silhouettes to be securely and efficiently fastened to commonly used wood target posts and adjusted to any height desired by the user.

More specifically, the wood post mounting bracket is made from high grade AR-550 Abrasion Resistant Steel that will withstand the impact of misplaced bullets at any angle. Many existing targets use low grade angle iron and tubing, which is susceptible to damage and unpredictable bullet/projectile direction/deflection.

The target in some forms has a minimum 20 degree angle when used with the bracket described herein. This provides downward direction to the projectile and a more predictable bullet deflection. Many existing targets do not have a built-in safety angle for the impact zone.

Existing targets secure the target silhouette with bolts or hardware that can be impacted by a projectile, damaged, and also send the bullet in an unpredictable direction. The bracket has a slotted mounting system that allows for easy mating between the interchangeable impact zone and the wood post mounting bracket.

Applicant's invention can be used with existing target shapes, such as the "industry standard" IPSC torso target, or with suitable custom made target pieces, including steel target pieces.

For the aspects that include a mechanical tightening device, McMaster-Carr Part No. 90044A165 is an exemplary Steel Socket Head Screw, and McMaster-Carr Part No. 90499A033 is an exemplary High Strength Steel Hex Nut (the specification sheet for those parts are provided herewith and incorporated by reference herein). McMaster-Carr Part No. 7122A26 is an exemplary Hex L-Key for use with certain aspects of the invention (the specification sheet for that part is provided herewith and incorporated by reference herein). In the alternative, McMaster-Carr Part No. 91285A119 (the specification sheet for that part is provided herewith and incorporated by reference herein) is an exemplary High Strength T-Bolt that can be used for tightening by coupling with High Strength Steel Hex Nut McMaster-Carr Part No. 90499A033. These are merely examples of hardware suitable for use with the wood post mounting bracket.

In another aspect, a housing attachment is added to the wood post mounting bracket discussed herein (and in Provisional Application No. 62/925,091) for safely housing electronic equipment (or other material that needs to be protected) behind the target. This housing attachment is mounted on the rear of the wood post bracket and is bolted in place. The housing attachment is comprised of plate steel. The electronic equipment may comprise an electronic sensor for sensing and relaying vibrations and or impacts to the target after being hit with projectiles, and the housing attachment may include holes to route wiring of the electronic equipment out of the attachment. McMaster-Carr Part No. 91251A624 is an exemplary alloy steel socket head cap screw for securing the housing attachment to the wood post mounting bracket (the specification sheet for that part is provided herewith and incorporated by reference herein). McMaster-Carr Part No. 97135A418 is an exemplary nylon insert lock nut for securing the housing attachment to the wood post mounting bracket (the specification sheet for that part is provided herewith and incorporated by reference herein). These are merely examples of hardware suitable for use with the invention.

In another aspect, a housing attachment is added to the shooting target system discussed in application Ser. No. 16/748,915, application Ser. No. 16/027,348 (now U.S. Pat. No. 10,634,464), and Provisional Application No. 62/528,751 for safely housing electronic equipment (or other material that needs to be protected) behind the target of that system. This housing attachment is mounted on the rear of the shoot target and slides into place over the steel post, wherein a bolt can further secure the attachment to the steel post. The attachment is comprised of plate steel. The electronic equipment may comprise an electronic sensor for sensing and relaying vibrations and or impacts to the target after being hit with projectiles, and the attachment may include holes to route wiring of the electronic equipment out of the attachment. McMaster-Carr Part No. 91285A119 (the specification sheet for that part is provided herewith and incorporated by reference herein) is an exemplary High Strength T-Bolt that can be used for securing the attachment to the steel post by coupling with High Strength Steel Hex Nut McMaster-Carr Part No. 90499A033. These are merely examples of hardware suitable for use with the invention.

SUMMARY

Aspects and applications of the invention presented here are described below in the drawings and detailed description of the invention. Unless specifically noted, it is intended that the words and phrases in the specification and the claims be given their plain, ordinary, and accustomed meaning to those of ordinary skill in the applicable arts. The inventor is fully aware that he can be his own lexicographer if desired. The inventor expressly elects, as his own lexicographer, to use only the plain and ordinary meaning of terms in the specification and claims unless he clearly states otherwise and then further, expressly sets forth the "special" definition of that term and explains how it differs from the plain and ordinary meaning. Absent such clear statements of intent to apply a "special" definition, it is the inventor's intent and desire that the simple, plain and ordinary meaning to the terms be applied to the interpretation of the specification and claims.

The inventor is also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventor is fully informed of the standards and application of the special provisions of post-AIA 35 U.S.C. § 112(f). Thus, the use of the words "function," "means" or "step" in the Detailed Description or Description of the Drawings or claims is not intended to somehow indicate a desire to invoke the special provisions of post-AIA 35 U.S.C. § 112(f), to define the invention. To the contrary, if the provisions of post-AIA 35 U.S.C. § 112(f) are sought to be invoked to define the inventions, the claims will specifically and expressly state the exact phrases "means for" or "step for," and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventor not to invoke the provisions of post-AIA 35 U.S.C. § 112(f). Moreover, even if the provisions of post-AIA 35 U.S.C. § 112(f) are invoked to define the claimed inventions, it is intended that the inventions not be limited only to the specific structure, material or acts that are described in the preferred embodiments, but in addition, include any and all structures, materials or acts that perform the claimed function as described in alternative embodiments or forms of the invention, or that are well known present or later-developed, equivalent structures, material or acts for performing the claimed function.

The aspects, features, and advantages will be apparent to those artisans of ordinary skill in the art from the DETAILED DESCRIPTION and DRAWINGS. However, without attempting to characterize or limit the scope of inventions as they are described and claimed, some of the advantages of the various inventions are summarized below.

The shooting targets and related accessories and inventions described herein are designed with improvements in at least four areas: Shooter safety, Quality, Versatility, and Portability.

Existing targets are often in fixed positions with permanently attached bases, making them difficult to transport, move around, and set up. Furthermore, existing targets often do not always account for safe, predictable bullet deflection with a variety of calibers and projectile velocities.

It is an object of the invention to provide a shooting target that is easier to transport and set up. The invention is intended to work with common dimensional lumber known as a 2×4—in two different rotational configurations and virtually limitless (only limited by the height of the post) vertical adjustability.

It is yet another (and optionally independent) object of the invention to provide a shooting target that maintains a safe 20-degree projectile deflection angle toward the ground while maintaining portability and durability.

It is yet another (and optionally independent) object of the invention to provide a shooting target that predictably and safely deflects projectiles along a well-defined path below the target.

It is yet another (and optionally independent) object of the invention to provide a shooting target that attaches the target silhouette without bolts or other hardware that can be impacted by a projectile or damaged, or that send or deflect the bullet in an unpredictable direction.

It is yet another (and optionally independent) object of the invention to provide an improved target system that can be easily scaled to many different silhouette shapes and sizes.

It is yet another (and optionally independent) object of the invention to provide a housing attachment for safely housing electronic equipment or other important objects behind the shooting target, wherein the equipment may an electronic sensor for sensing and relaying positions on the target that are hit by projectiles.

In one form of the invention, a shooting target is provided that includes a target plate (of any desired shape) that is coupled with or secured to the front portion of the mounting bracket. The mounting bracket is comprised of 6 interlocking steel plates, which in some forms are welded together. In addition, a threaded portion of the bracket allows for a bolt to tighten the bracket to the wood. The wood post mounting bracket can now be affixed to a wood post by sliding it over the top of the vertically stable wood post and securing in place with mechanical force/friction with the bolt. The mechanical friction is obtained by tightening the threaded bolt against the wood post.

In one form of the invention, the threaded screw or bolt may be any of the widely available "Cap Screw" or "Hex Bolt". Threaded screws are available in many forms and grades and are inserted into one or more holes to fix a component's position, join components, or maintain alignment between them in assemblies that require frequent adjustment.

In one form of the invention, post bracket, target plate, and bottom plate are comprised of a hardened steel. Preferably the hardened steel has a Brinell hardness rating of at least 500.

In one form of the invention, a housing attachment for safely housing electronic equipment or other important objects behind the shooting target is added to the wood post mounting bracket (or added to the target system described in application Ser. No. 16/748,915, application Ser. No. 16/027,348 (now U.S. Pat. No. 10,634,464), and Provisional Application No. 62/528,751). The electronic equipment in one form of the invention includes an electronic sensor for sensing and relaying positions on the target that are hit by projectiles.

BRIEF DESCRIPTION OF THE SEVERAL VIEWS OF THE DRAWINGS

A more complete understanding of the present invention may be derived by referring to the detailed description when considered in connection with the following illustrative figures. In the figures, like reference numbers refer to like elements or acts throughout the figures.

Elements and acts in the figures are illustrated for simplicity and have not necessarily been rendered according to any particular sequence or embodiment.

DETAILED DESCRIPTION

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and devices are shown or discussed more generally in order to avoid obscuring the invention. In many cases, a description of the operation is sufficient to enable one to implement the various forms of the invention, particularly when the operation is to be implemented in software. It should be noted that there are many different and alternative configurations, devices and technologies to which the disclosed inventions may be applied. The full scope of the inventions is not limited to the examples that are described below.

Figure 1:
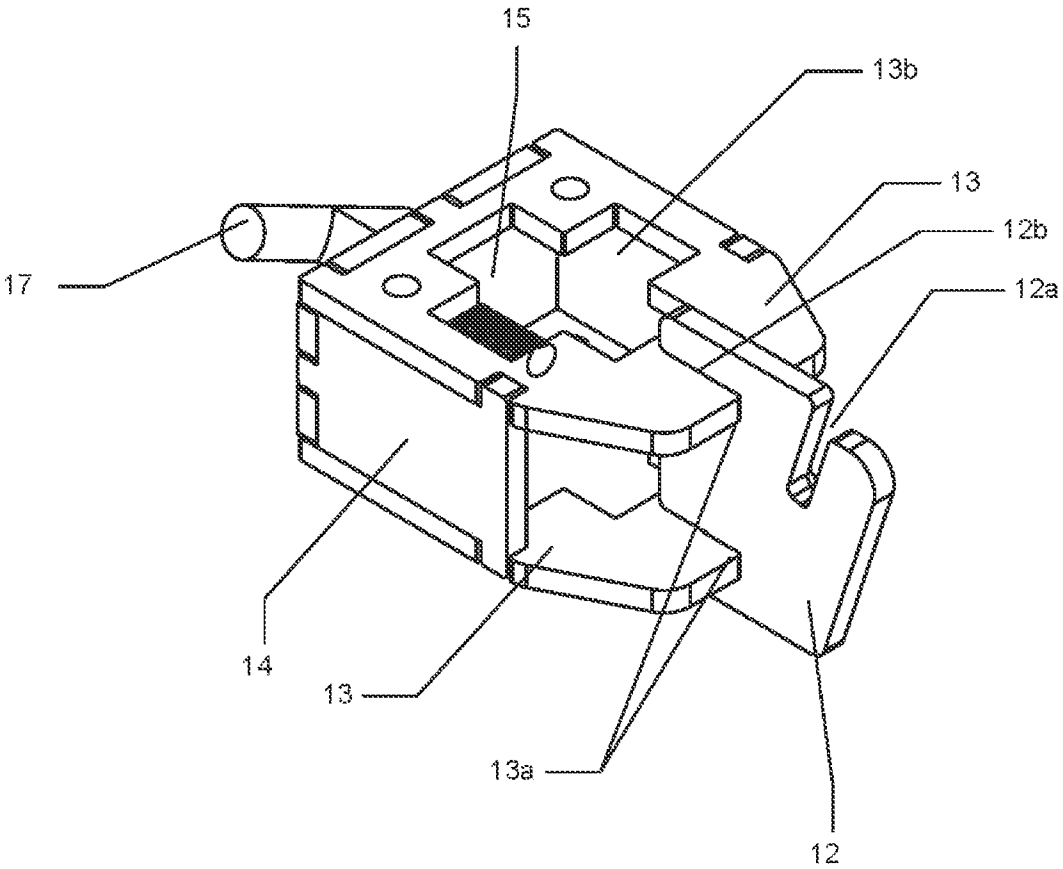
FIG. 1 depicts an isometric view of a first form of the bracket.
Figure 2:
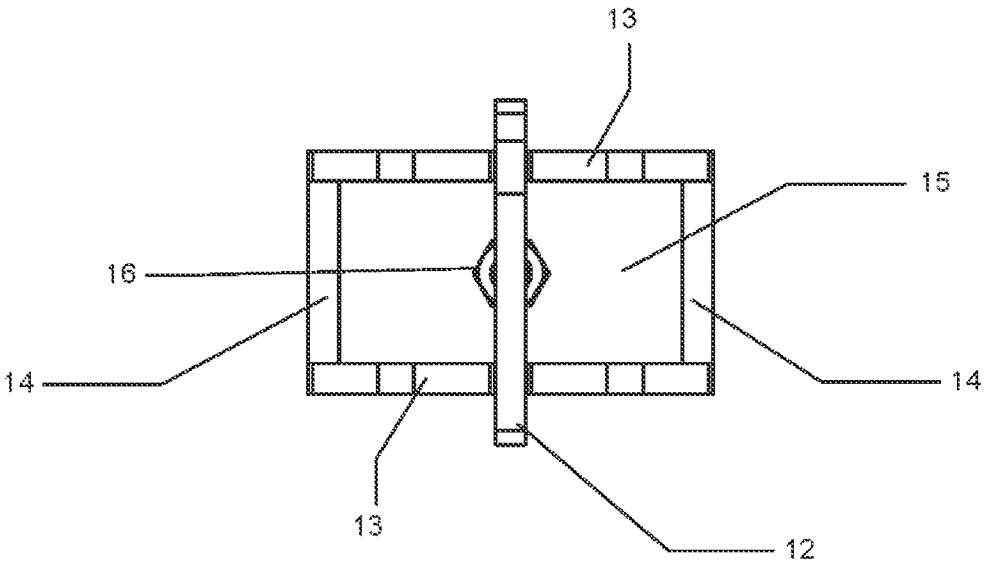
FIG. 2 depicts a front view of the first form.
Figure 15:
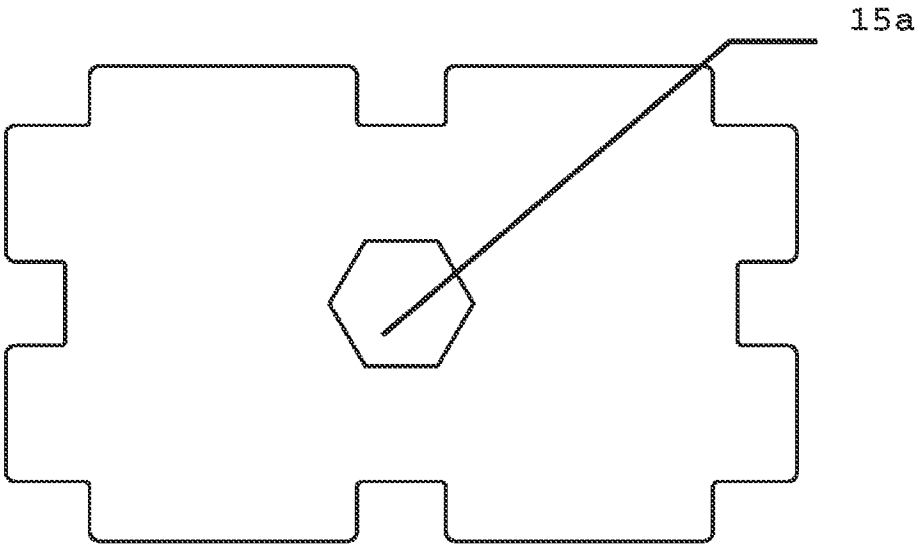
FIG. 15 depicts a view of Part 15.
Figure 16:
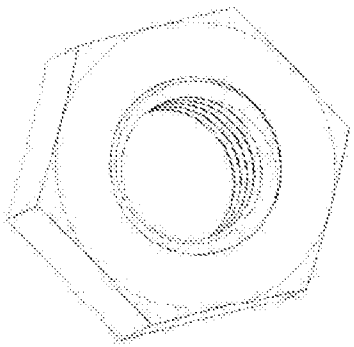
FIG. 16 depicts a view of Part 16.
Figure 17:
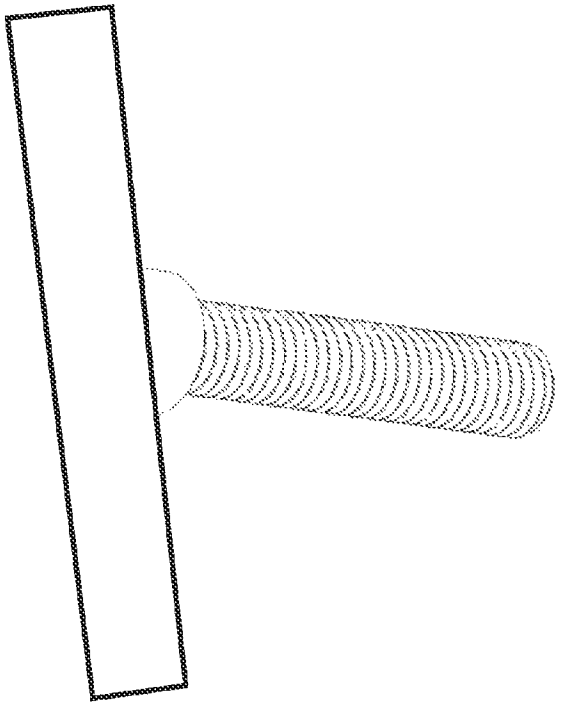
FIG. 17 depicts a view of Part 17.
Figure 18:
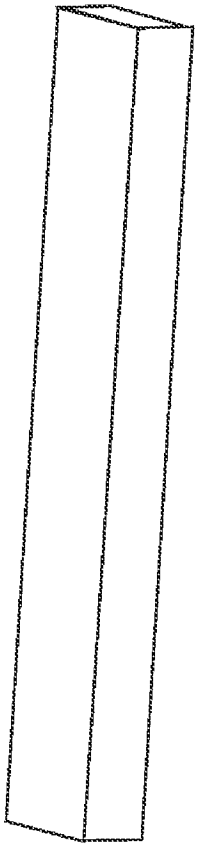
FIG. 18 depicts a view of Part 18.
Figure 19:
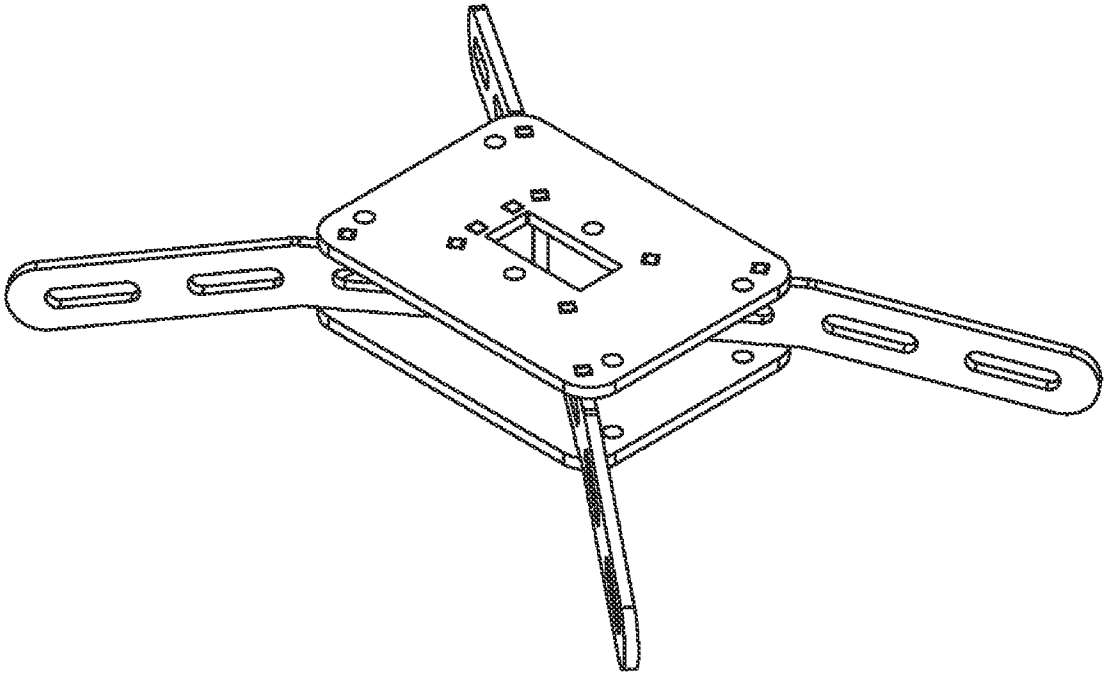
FIG. 19 depicts a view of Part 19.
Figure 20:
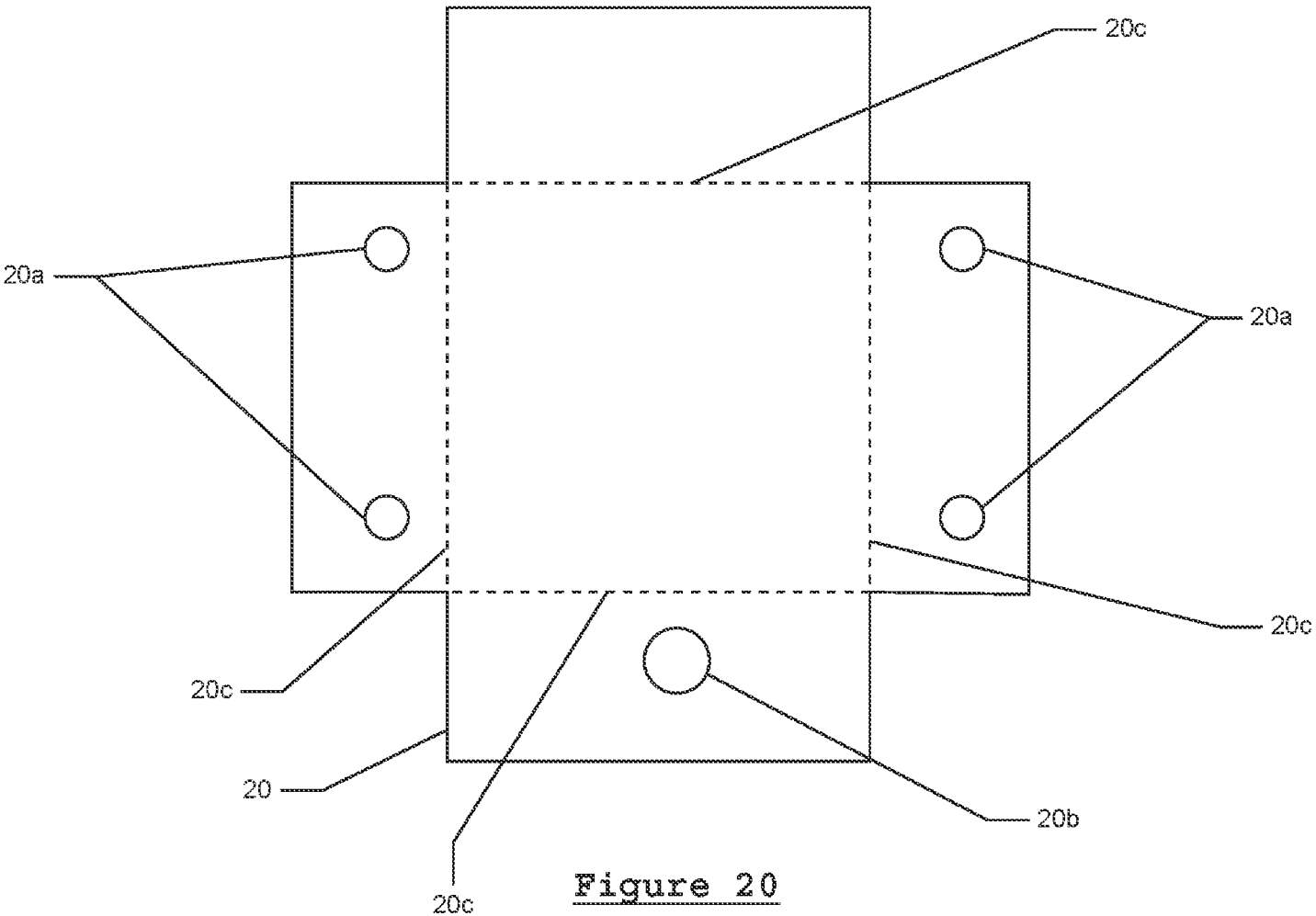
FIG. 20 depicts a view of Part 20 prior to mechanical formation.

FIGS. 1 and 2 depict the wood post "bracket assembly" which is a combination of Parts 12, 13, 14, 15, 16, and 17. This assembly is usually created by welding the parts together (Parts 12, 13, 14, 15, and 16) or it can be formed in whole or in part by injection molding or other machining/metallurgy techniques. Part 17 is threaded into the back of the bracket welded assembly through Part 15. Part 15 is shown with a hole 15*a* (see FIG. 15). Part 16 is welded into hole 15*a* so that Part 17 can be threaded through Part 16 and Part 15 to apply pressure to the wood post Part 18 and keep the bracket locked into place with the post. Alternatively, hole 15*a* has threads so that part 17 is threaded through it directly. Once assembled, all the mentioned parts create a structurally sound and functional bracket that will be mechanically held in position on a post. Slots are paired as follows: (Part 12*a* with 11*a*) and (Part 12*b* with 13*a*) and (Part 13*b* with 18).

Figure 3:
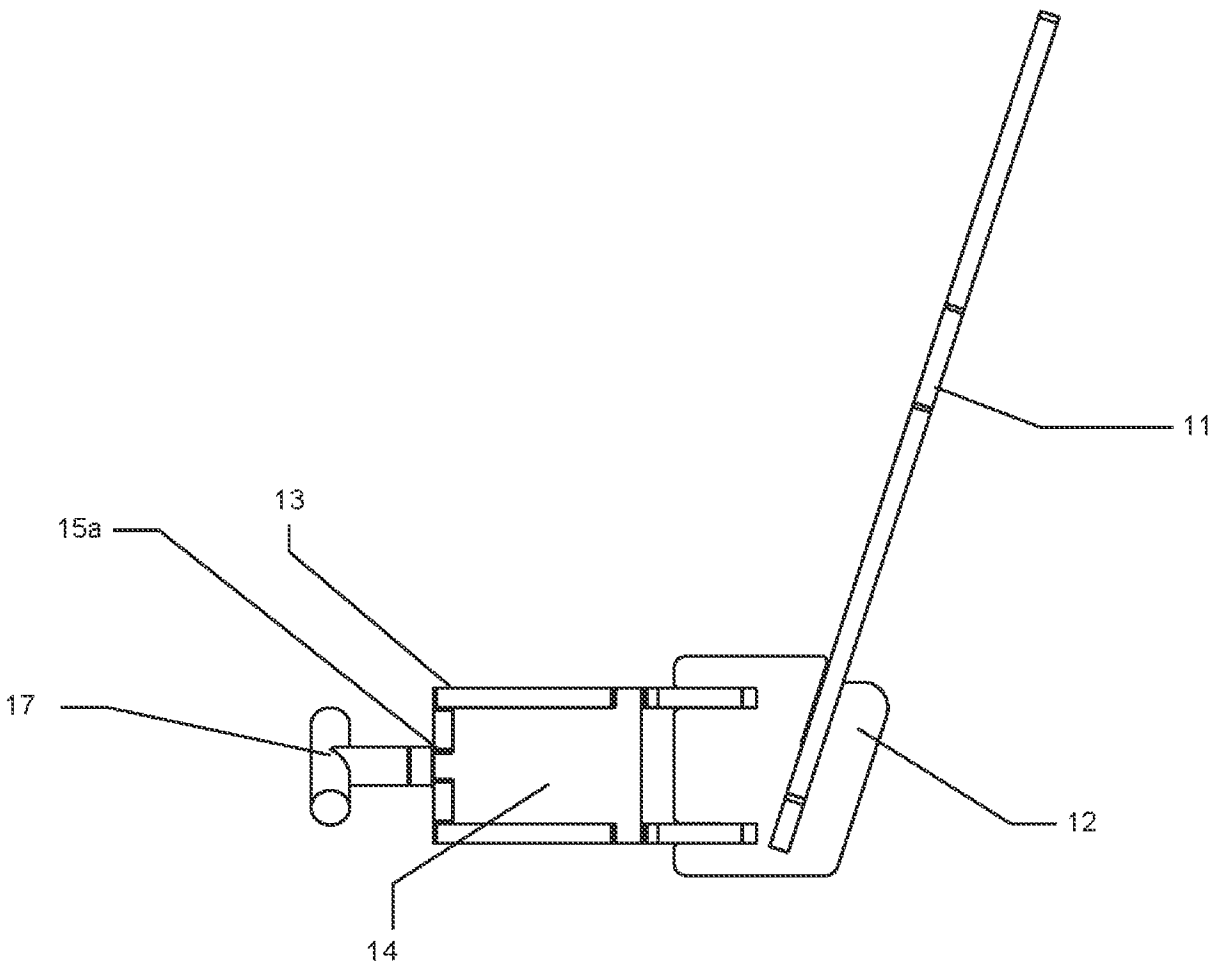
FIG. 3 depicts side view of the first form with the target silhouette in place.

FIG. 3 shows the temporary connection of Parts 11 and 12, through the means of Parts 11*a* and 12*a*. The joining of these two parts is done by aligning like sized slots and pushing the parts together. This interlocking function keeps the two parts from rotating and will be held in through friction, interlocking, and full force of gravity. (Part 12*a*) is shown held into place with a 20 degree forward leaning slot, and when joined with (Part 11), the 20 degree safety shooting angle is thus defined. Other angles can be used instead, by adjusting the slot angle 12*a* in part 12. FIG. 3 also shows how (Parts 12*b* and 13*a*) slide together in a similar fashion to (Parts 11*a* and 12*a*), but these are in some forms welded or otherwise more permanently connection, rather than being held only by gravity and interlocking.

Figure 4:
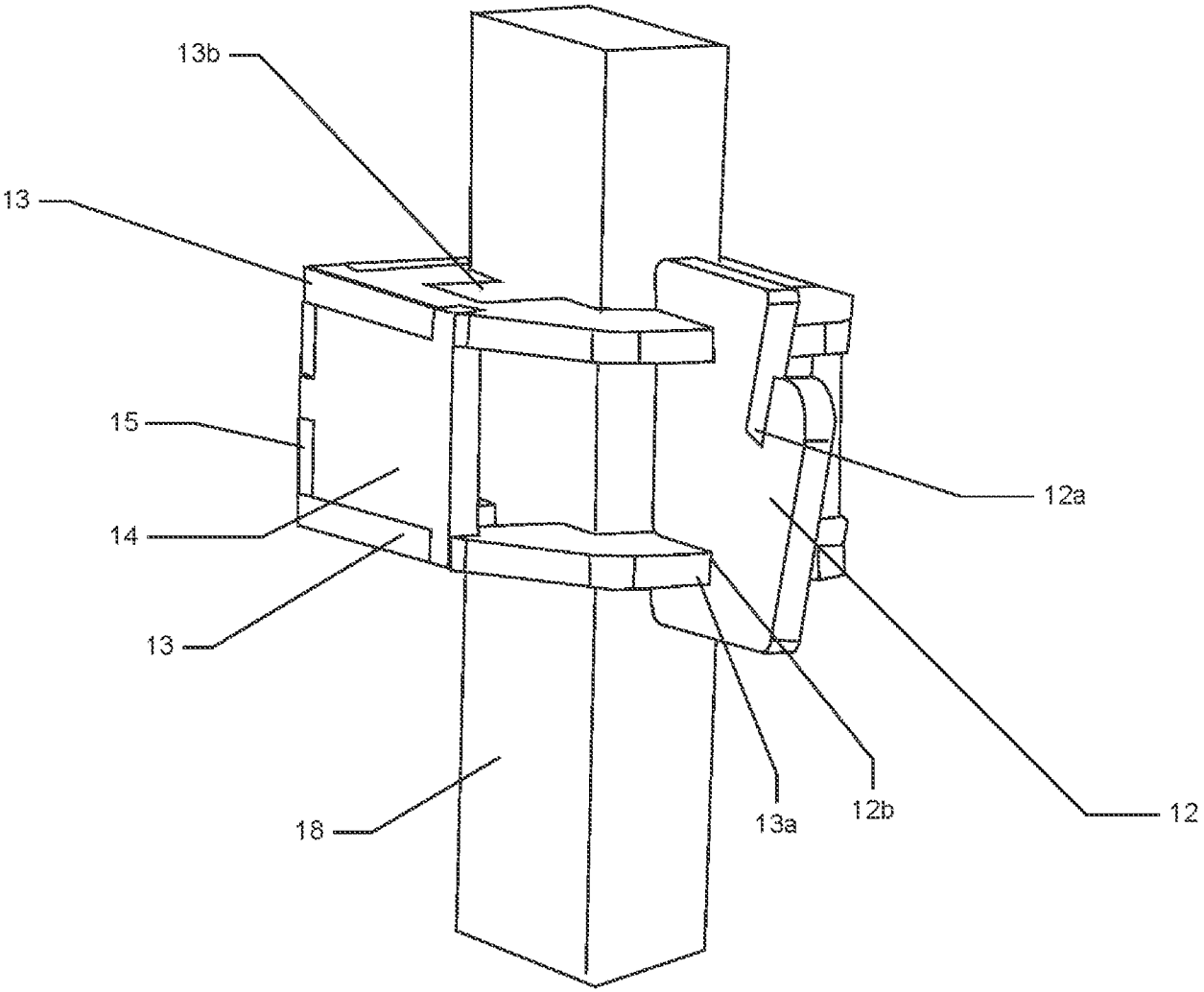
FIG. 4 depicts a view of the first form attached to a wood post.
Figure 5:
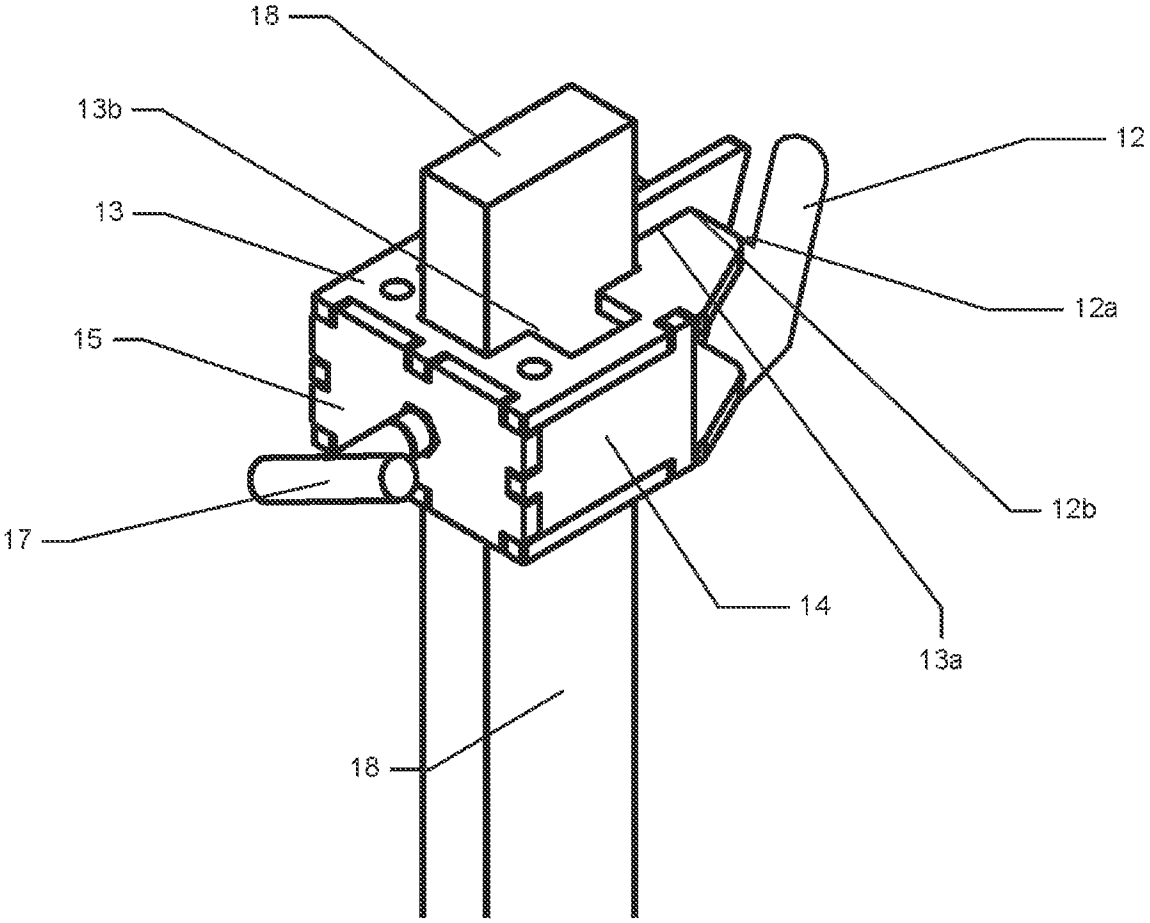
FIG. 5, depicts another view of the first form attached to the wood post.
Figure 6:
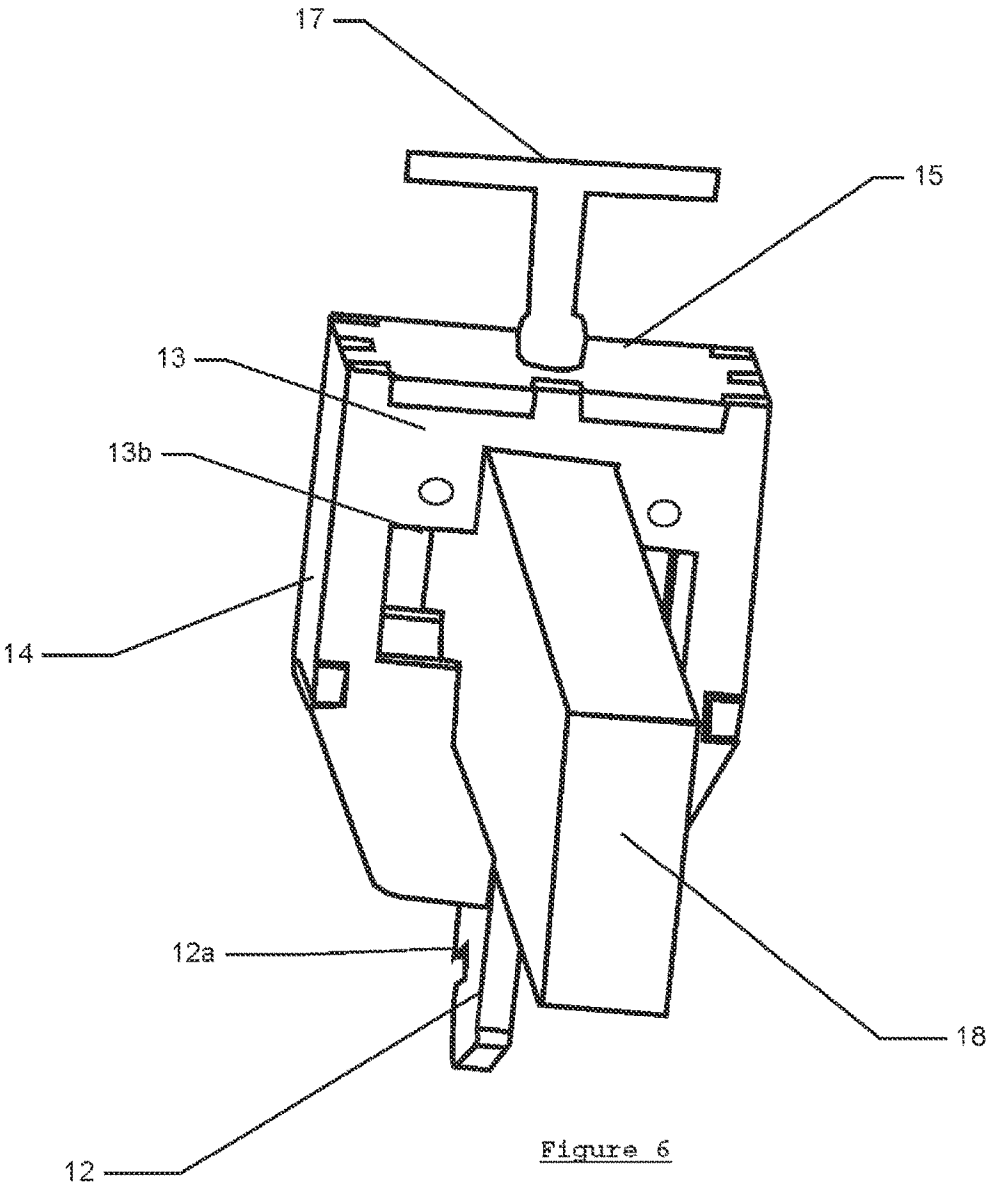
FIG. 6, depicts a bottom view of the first form attached to the wood post (but with no base attached to the post).

FIGS. 4, 5 and 6 include the integration of a main wood rectangular upright post (Part 18). Any post can be used—for example (Part 18) can have standard dimensional properties of: 1.5" length, 3.5" width (otherwise known as a "2×4") and various heights depending on application. Previously mentioned (Part 13*b*) accepts the upright post (Part 18). The wood post bracket is intended to slide over a vertical stabilized 2×4. Part 18 can be inserted in two ways: The first is "Parallel" and the second way is "perpendicular" to the impact target (Part 11). The "perpendicular" set up is depicted in FIGS. 4-10. This variant of use is depending on manufacturer and/or user preference. The bracket can be slidably adjusted up and down the vertical post until it is at a desired height. Once a desired height is obtained, the user will use Part 17 to apply mechanical pressure/friction onto Part 18, and therefore temporarily lock the bracket into place on the post. Specifically, Part 17 is threaded through Part 16 that is welded at hole 15*a* of Part 15. Alternatively, hole 15*a* has threads so that Part 17 is threaded through it directly. With this system, the bracket's vertical position is easy to adjust, and a standard post is now converted (through the bracket) to a post that can mount steel target silhouettes or other high quality silhouettes that are compatible with the bracket. It is an "aftermarket" bracket that works very well with existing systems in that it can be easily attached/detached and adjusted to an appropriate height. The cross design and bolt also ensure that the bracket is securely attached to the post, even though it is adjustable and removable.

Figure 7:
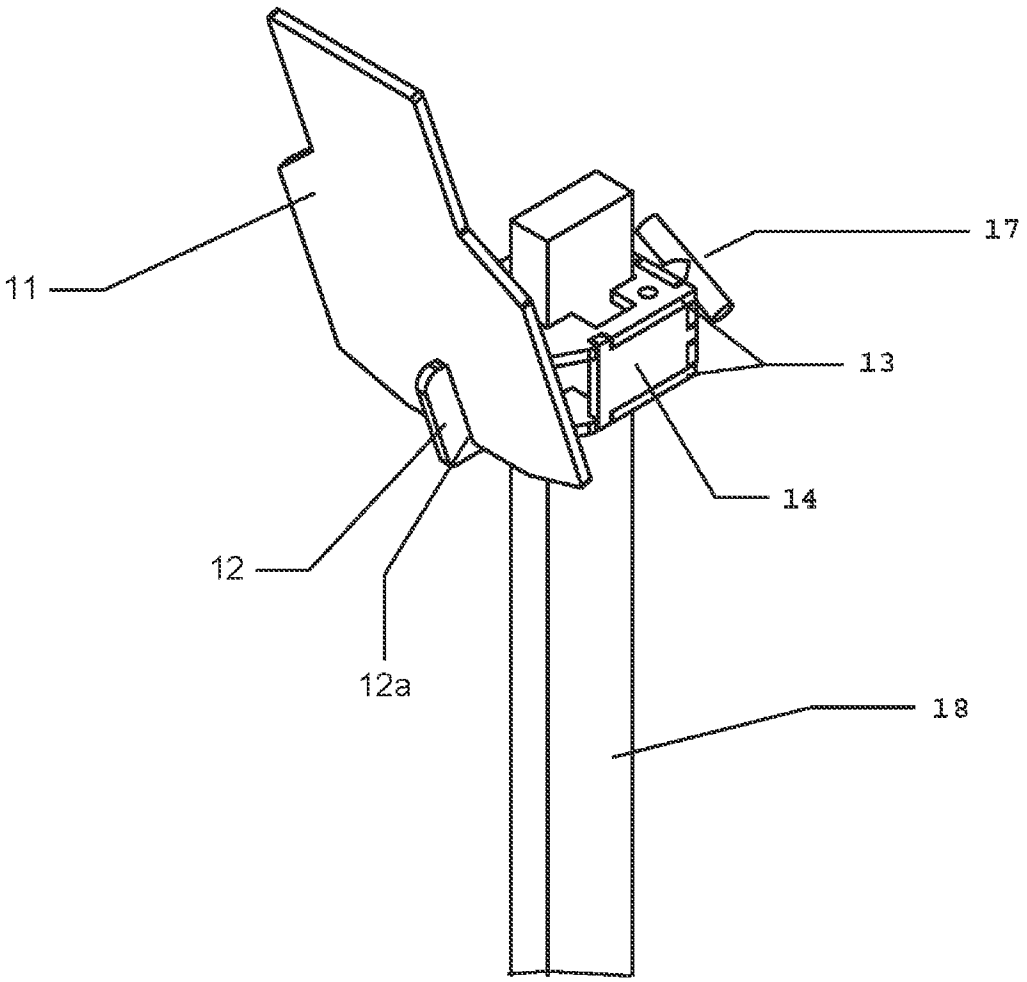
FIG. 7, depicts the first form from the upper/front quadrant with the target silhouette in place. The bracket can be adjusted along the vertical wood post.
Figure 8:
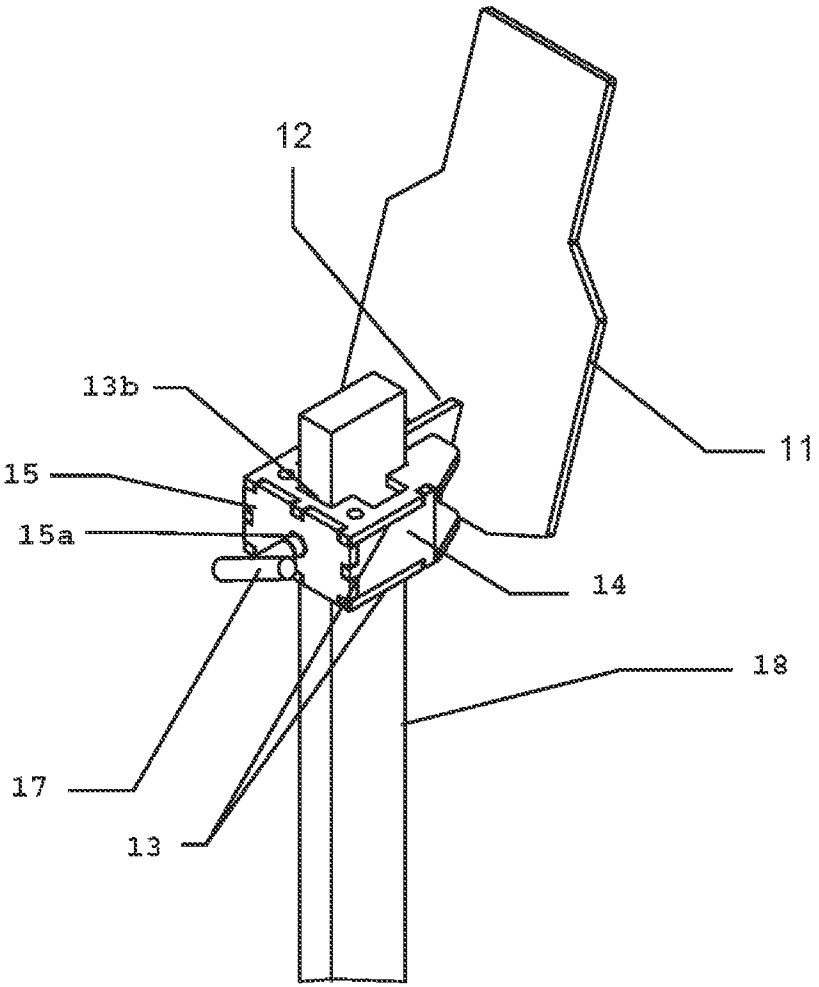
FIG. 8 depicts the first form from the upper/rear quadrant with the target silhouette in place. The bracket can be adjusted along the vertical wood post. The threaded screw is also shown to illustrate how mechanical friction can be applied to the wood post and secure the bracket along the vertical wood post.
Figure 9:
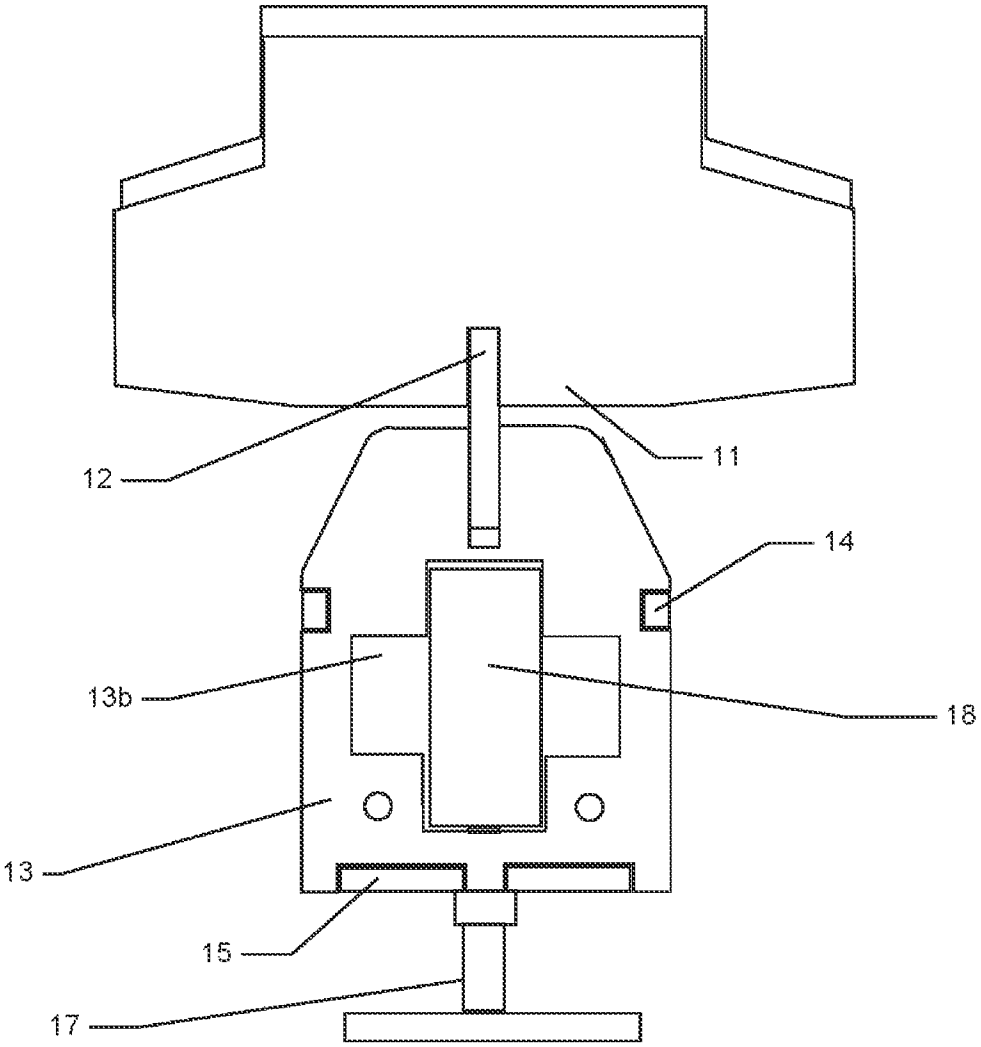
FIG. 9 depicts the first form from the top with the target silhouette in place and the bracket attached to the post. This view also shows how the rectangular wood post can fit within the bracket in two ways: with the long side of the wood post parallel OR perpendicular to the impact target (shown as perpendicular in FIG. 9). The threaded screw is also shown to illustrate how mechanical friction can be applied to the rectangular wood post and therefore securing the invention along the vertical wood post.

FIGS. 7, 8 and 9 further illustrate the previously described target with additional angles of view.

Figure 10:
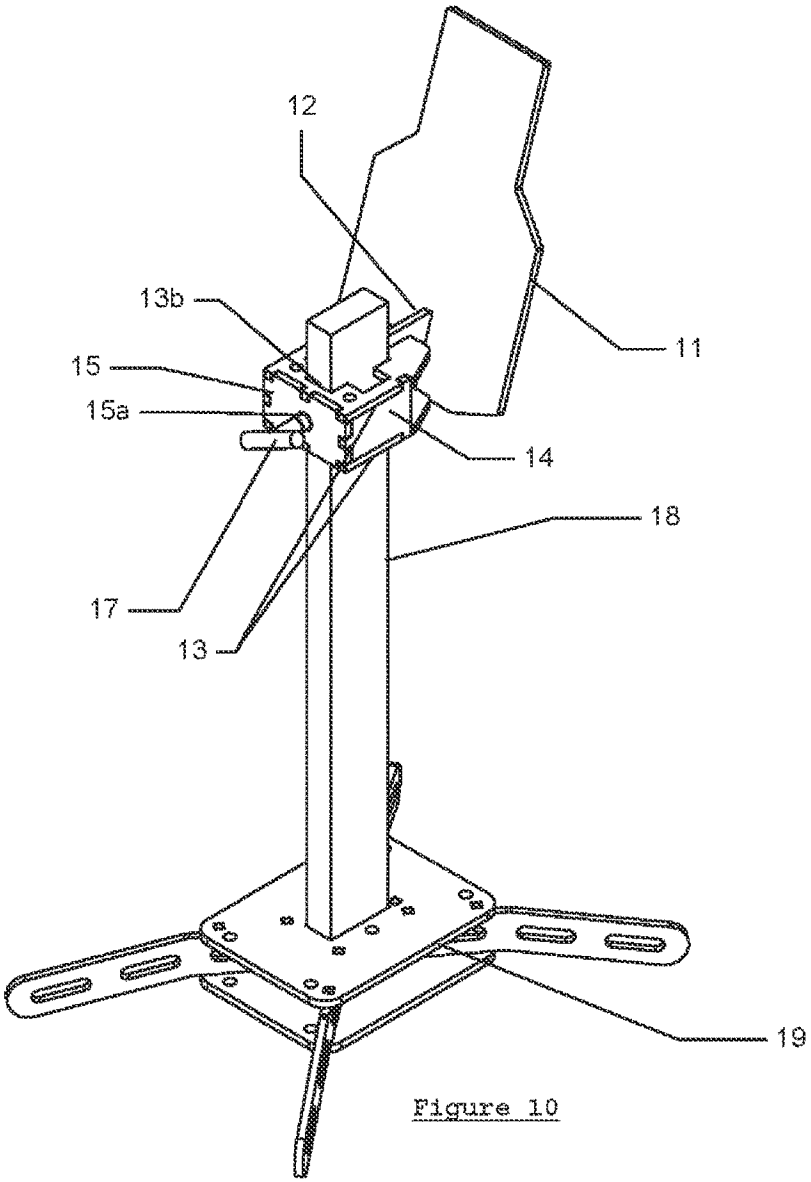
FIG. 10 depicts the first form from the rear/side view with the bracket on the wood post and with the target silhouette in place. The bracket can be adjusted along the vertical wood post. This view also shows how the rectangular wood post can fit within the bracket in two ways: with the long side of the wood post parallel OR perpendicular to the impact target (shown as perpendicular in FIG. 10). The threaded screw is also shown to illustrate how mechanical friction can be applied to the rectangular wood post and therefore securing the invention along the vertical wood post. Furthermore, the post is shown with a common and widely used steel base structure. This steel base or "stand" is available on the market. This steel base is used to support the main vertical rectangular wood post. This steel base is often made from tubular steel and angle iron. The design of this base plate is intended to support a rectangular 2×4 wood post in a vertical fashion in 1 of two ways: Parallel or perpendicular to the impact target. This variant of use is depending on manufacturer or user preference. The invention is designed to work with all steel base designs that support a wood post in a vertical manner. In addition, the post can be made from steel or other material—the bracket works with essentially any type of post suitable for shooting targets, and the cross center cutout 14*b* can be appropriately sized for whatever posts it needs to mate with. Also, in alternate forms, a slot that fits over the post is used rather than the cross center cutout that provides two configurations for fitting over the post.
Figure 11:
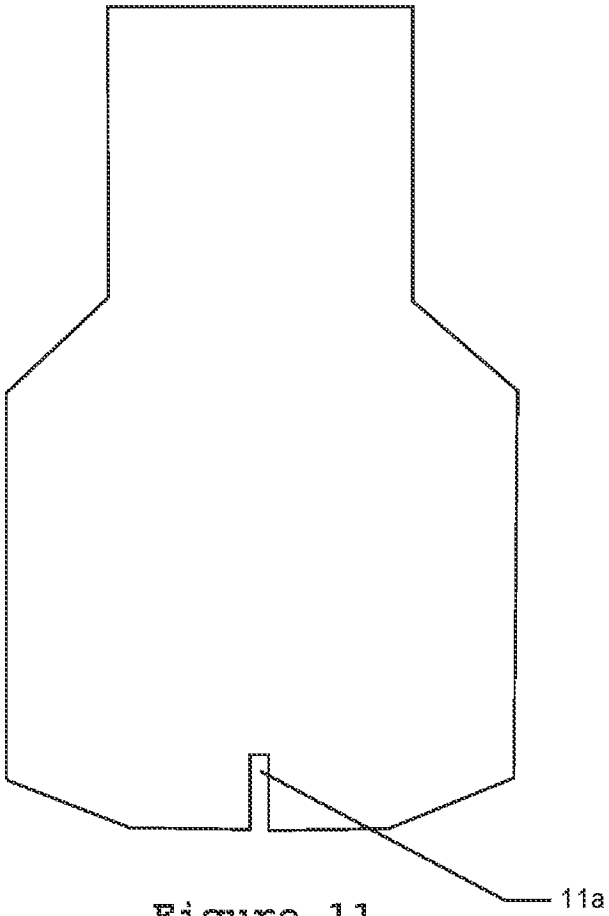
FIG. 11 depicts a view of Part 11.
Figure 12:
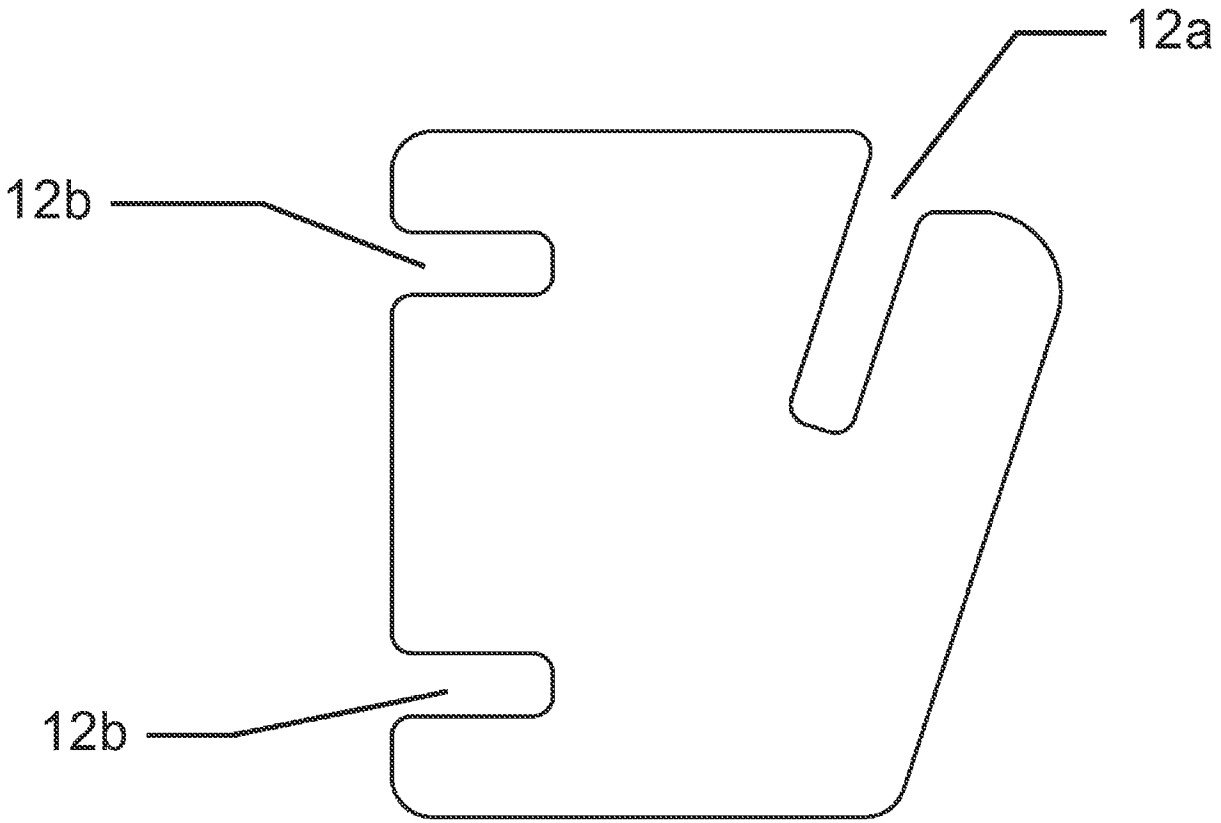
FIG. 12 depicts a view of Part 12.
Figure 13:
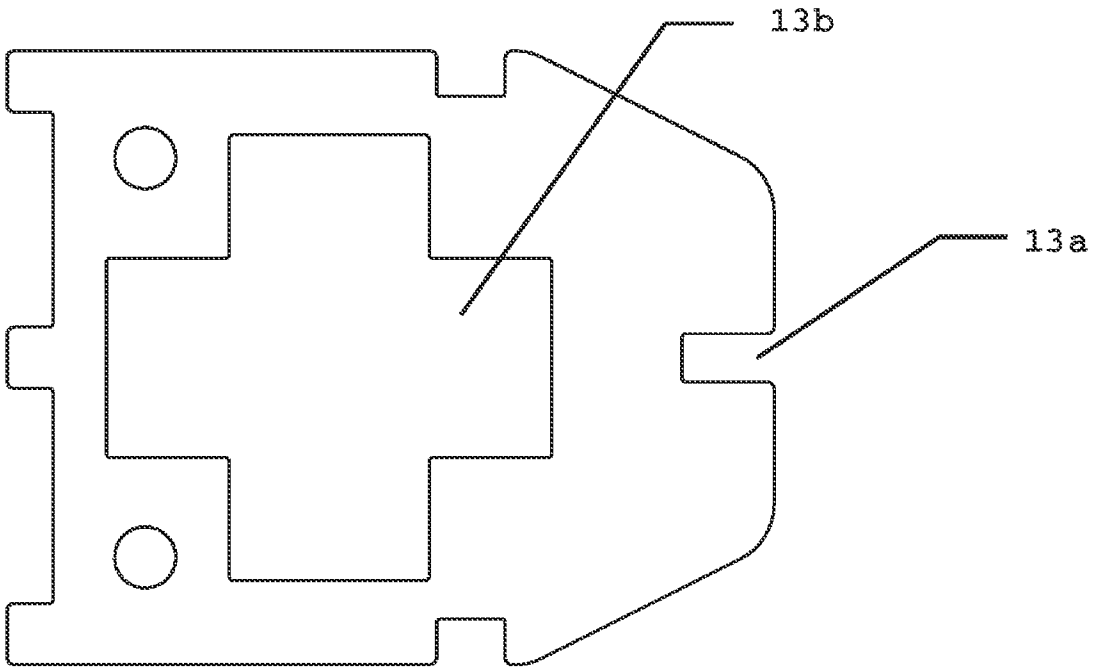
FIG. 13 depicts a view of Part 13.
Figure 14:
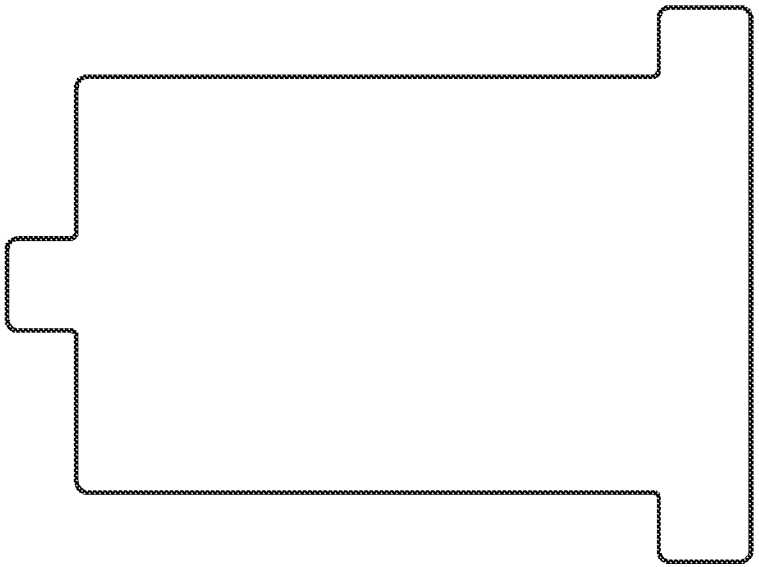
FIG. 14 depicts a view of Part 14.

FIG. 10 includes the base structure (Part 19). A "steel base" or "stand" is available on the market and it similar in function and design across many manufacturers. This base is used to support the main vertical rectangular wood post (Part 18). This base is often made from plate steel, tubular steel and/or angle iron. The invention is designed to work with any base designs that support a wood post in a vertical manner.

To further assist in understanding the bracket, additional descriptions of Parts are provided below:

Part 11—Target Silhouette.

Part 11 is in some forms made from hardened steel, usually ranging in hardness from 400 Brinell-550 Brinell. It is intended to be impacted with multiple bullet weights, sizes and velocity. This part could also be called a "Steel plate", or "Target silhouette" or "Target Plate". The shape and size of Part 11 can change depending on general design and/or size differences.

Part 11 will join with Part 12 through the slots shown as Parts 11*a* and 12*a*. These corresponding slots temporarily join the two pieces together and they are held in place by gravity/mechanical alignment and interlock.

Part 12.

Part 12 is in some forms made from hardened steel, usually ranging in hardness from 500 Brinell-550 Brinell. It is intended to be impacted with multiple bullet weights, sizes and velocity.

Part 12 will join with Part 11 through the slots shown as Parts 11*a* and 12*a*. These corresponding slots temporarily join the two pieces together and they are held in place by mechanical alignment/interlock. Gravity, along with the alignment/interlock of the 11*a* and 12*a*, will keep the two items joined together during normal conditions.

Part 12 will join with two Parts 13 (a top Part 13 and a bottom Part 13) through the slots shown as Parts 12*b* and 13*a*. These corresponding slots mechanically align/interlock to join the two pieces together, and are also in some forms welded for permanent bond.

Part 12*b*.

It is a design feature of Part 12 and allows for mechanical alignment/interlock between Part 12 and Part 13. Slots 12*b* and Part 13*a* are in some forms permanently bonded together by the use of welding after they are aligned.

Part 13.

Part 13 is in some forms made from hardened steel, usually ranging in hardness from 500 Brinell-550 Brinell. It is intended to withstand multiple hits from multiple bullet weights, sizes and velocity.

Part 13 will be used twice in order to fully assemble this product. Part 13 is used symmetrically, top and bottom of the assembled unit. Normally, Part 13 permanently joins with parts 12, 14, and 15 by the use of mechanical alignment/interlock and then welding, as shown for example in FIG. 1.

Part 13*b*. Is a symmetrical "cross like" center cutout that is designed to accept a wood post (for example, it can be sized for any 1.5"×3.5" wood post (AKA 2×4 lumber) (AKA TWO-BY-FOUR Lumber)). Because the cross design forms essentially two slots, the wood post can be inserted into either slot of the center cutout 13*b* for fastening the bracket to the post. FIG. 9 show just one of the two possible configurations—the other configuration (not shown) would be with the post rotated 90 degrees relative to the bracket. This design feature is unique, in that it allows the user to use the wood post in two different configurations, depending on how the user wants the bracket and target aligned relative to the post on which it is fastened.

Part 14—Protective Side Plates.

Part 14 is in some forms made from hardened steel, usually ranging in hardness from 500 Brinell-550 Brinell. It is intended to withstand multiple hits from multiple bullet weights, sizes and velocity.

Part 14 will be used twice in order to fully assemble this product (a left side plate 14 and a right side plate 14). Each Part 14 is in some forms permanently joined with top and bottom Parts 13 and Part 15 by the use of mechanical alignment/interlock (shown for example in FIG. 1) and/or welding.

When the user is shooting the product at an angle (Example 45 degrees), Part 14 protects the wood post and the mechanical tensioning bolt from projectile impact.

Part 15.

Part 15 is in some forms made from hardened steel, usually ranging in hardness from 500 Brinell-550 Brinell. It is intended to withstand multiple hits from multiple bullet weights, sizes and velocity.

The Part 15 back plate will be used only once in the assembled version of the product shown in the Figures. Part 15 is in some forms permanently joined with Parts 13 and Parts 14 (shown for example in FIG. 1) by the use of mechanical alignment/interlock and/or welding.

Part 15 has a round hole (Part 15*a*) which will allow for the penetration of a bolt 17.

Part 15 allows for bolt 17 to be threaded into Part 15—for example, Part 15*a* is itself threaded, or Part 16 is welded to Part 15 near Part 15*a* so that the treads in Part 16 can receive the bolt 17. Other known fastening methods can also be used—the objective is to allow for a bolt or other fastener to securely fasten the bracket to a wood post, while also being removable (and/or capable of being loosened).

Part 16.

Part 16 is in some forms constructed from high strength steel. Size will range from ⅜" ID to ⅝" ID.

Part 16 is threaded per standard specifications. (Example: ½"-13).

In one form, Part 16 will be welded to Part 15. This will allow for Part 17 to be threaded through Part 15 and make contact with wood post.

Part 17. Part 17 is in some forms constructed from high strength steel. Example (Grade 8 or Grade 9).

The size of Part 17 will in some forms range from ⅜" ID to ⅝" OD and 1.5" to 3" long, although it can be adjusted depending on the size of the wood post and bracket.

Part 17 is threaded into the back of Part 15 by the use of threads on Part 16, or in some forms, by using threads that are machined into hole 15*a*.

Part 17 will ultimately be tightened against the wood post that is inserted into Part 13*b*. It is this mechanical tension/friction that will hold the entire unit in place at a specific height along the wood post. This bolt provides easy height adjustability along the vertical wood post, so that a user of the target can place the bracket and corresponding target silhouette at his desired height.

Part 18.

Part 18 is a common piece of dimensional lumber found in hardware stores or building supplies. For example, a "2×4".

Part 18 is inserted into Part 13*b* to set up the target on Part 18 for shooting, it is held in position though the use of mechanical force/friction from Part 17.

Part 19.

Part 19 is a base for the wood post 18—for example, this can be a common piece of equipment often found at local sporting goods stores or in major online retailers.

Part 19 commonly stabilized Part 18 in a vertical fashion so to add products such as this invention to the wood post.

Part 19 is often made from tubular or angle iron steel and has a means of inserting Part 18 into the steel frame. Part 19 can be any suitable base for the post that will hold the weight of the system and withstand shots without allowing the post and target to tip over.

The description below relates to the housing attachments for housing equipment.

Part 20:

Part 20 is in some forms constructed from steel.

As depicted in the example shown in the figures, Part 20 has two holes on the left side (20*a*) and two holes on the right side (20*a*), and 1 hole on the bottom (20*b*). These holes are typically used to route electronic cords or wires from inside of the 5 sided shape Part 20 to the outside.

Figure 21:
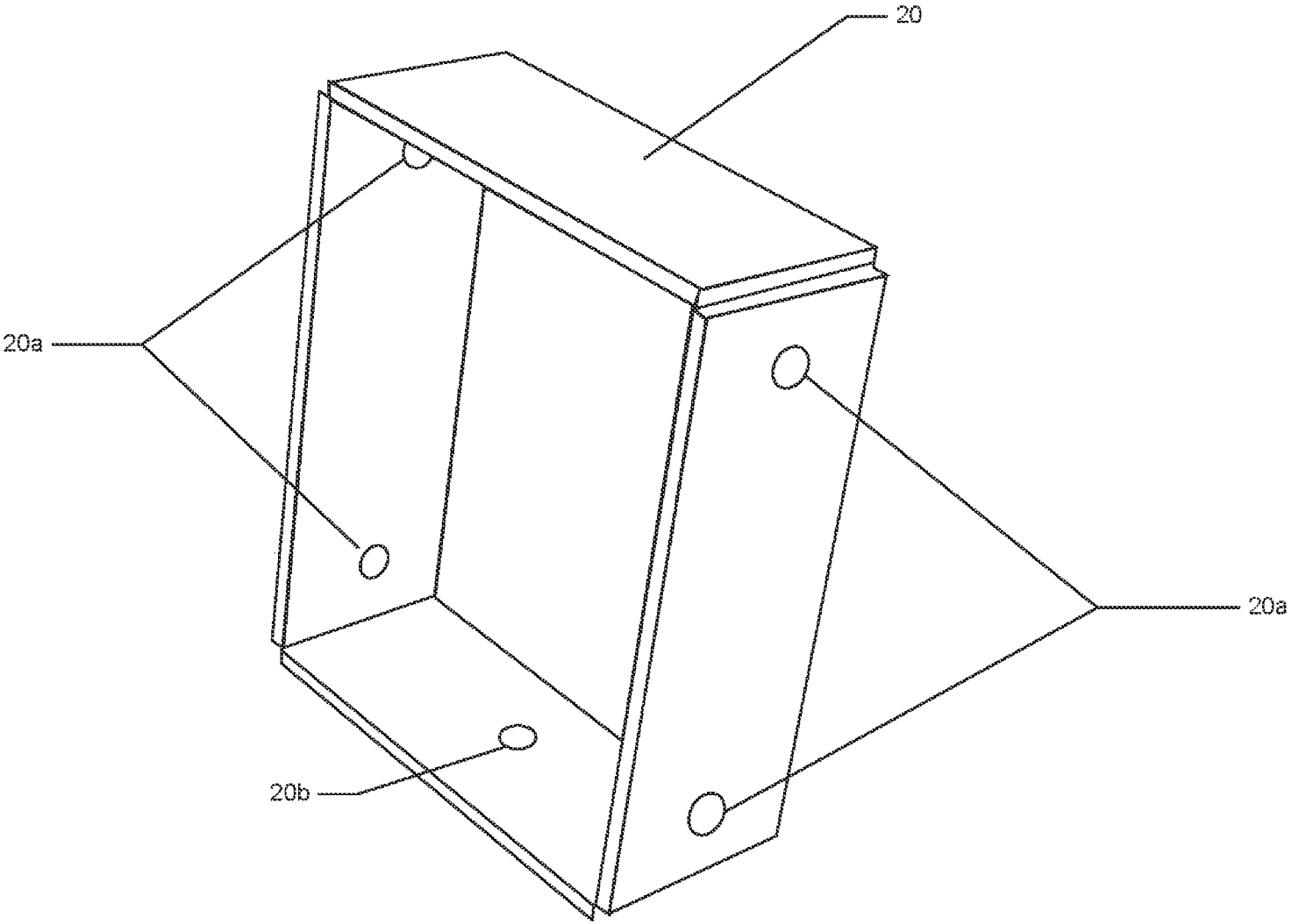
FIG. 21 depicts an isometric view of the back side of Part 20 after mechanical formation.
Figure 22:
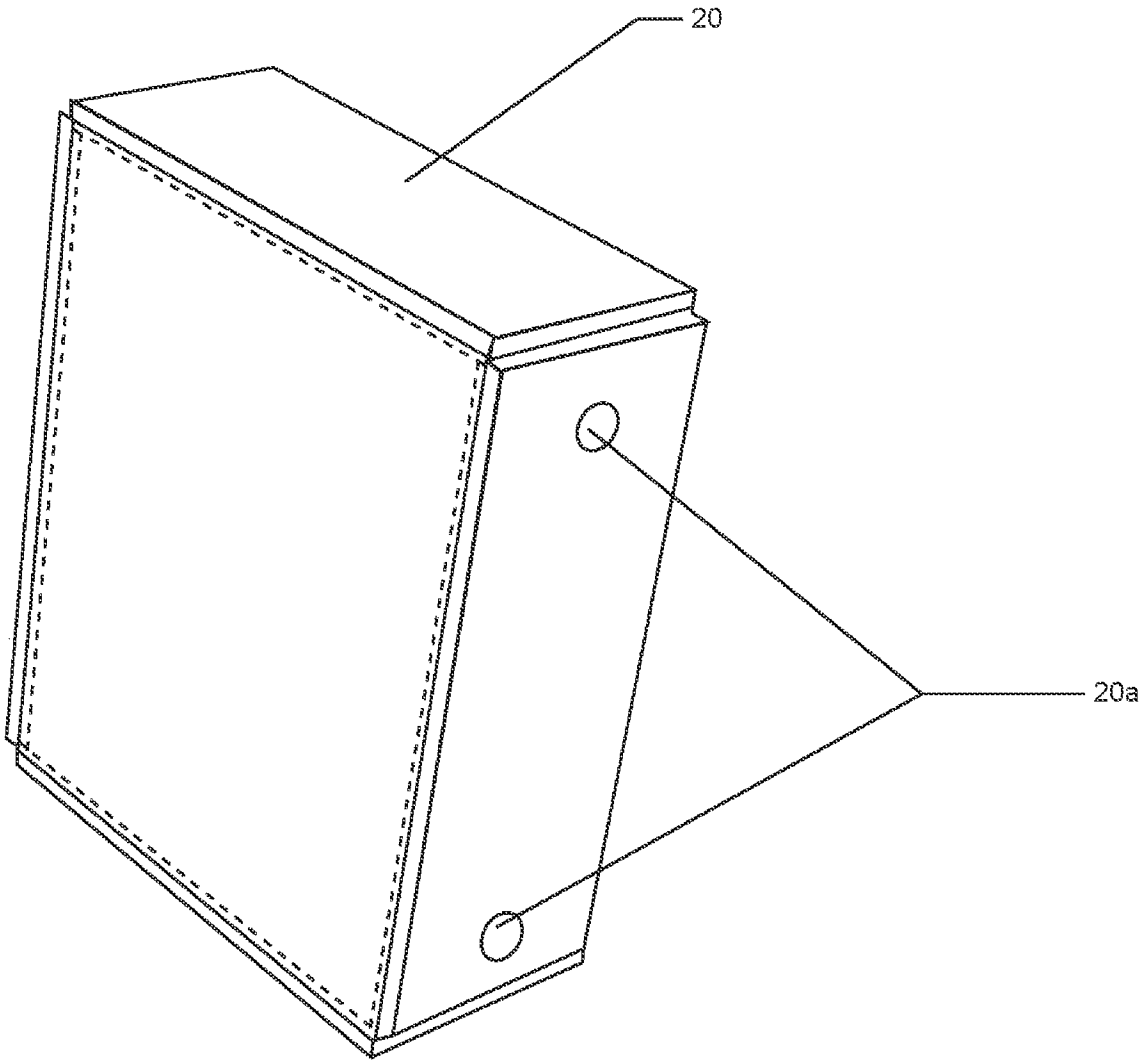
FIG. 22 depicts an isometric view of the front side of Part 20 after mechanical formation.
Figure 23:
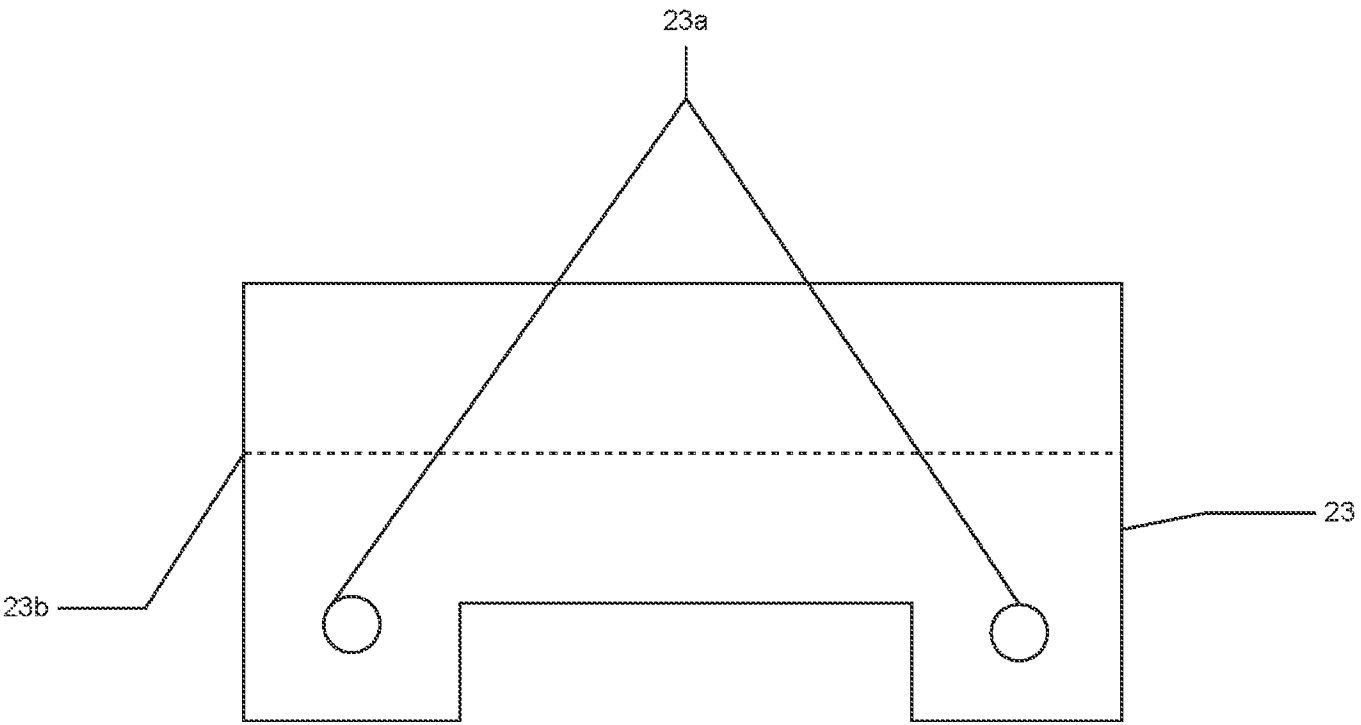
FIG. 23 depicts a view of Part 23 prior to mechanical formation.

In the example, Part 20 is bent to an approximately 90 degree angle along the dashed line shown 4 times total to make a 5 sided shape as shown in FIGS. 21 and 22. The shape provides protection from bullets or other projectiles on the front and sides, but access to the electronic equipment in the back.

Figure 24:
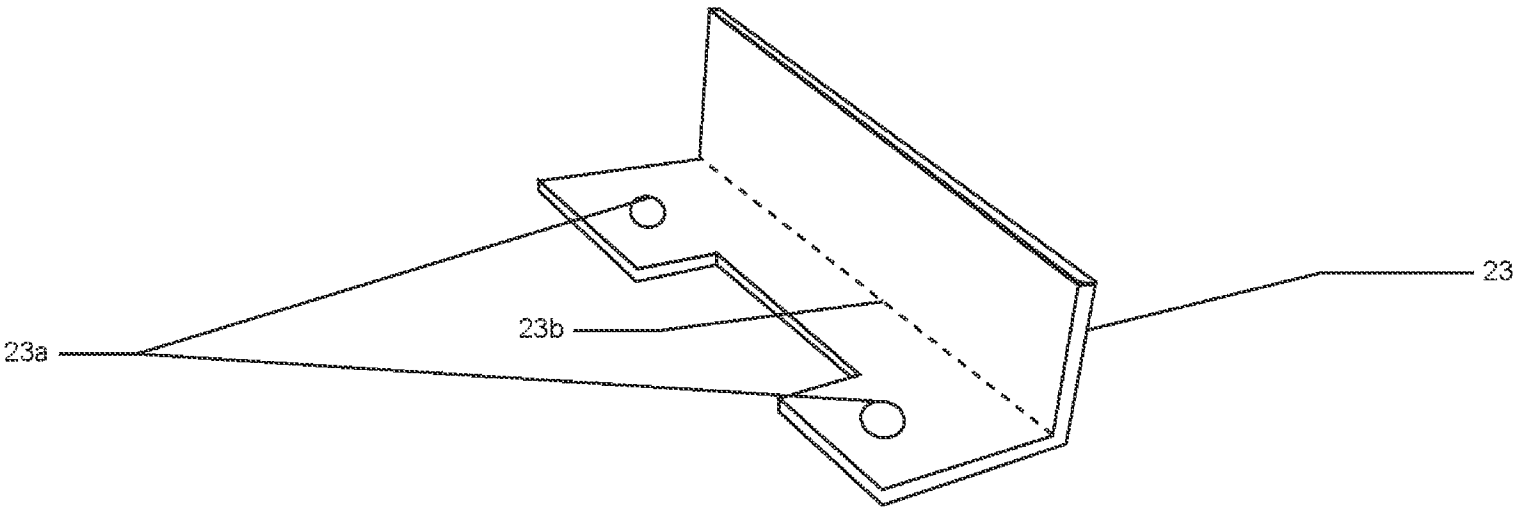
FIG. 24 depicts an isometric view of Part 23 after mechanical formation.

Part 23:

Part 23 is in some forms constructed from steel. In the example, Part 23 is bent along the dashed line (23*b*) at an approximately 90 Degree angle, as shown in FIG. 24.

As depicted in the example shown in the figures, Part 23 has two holes (23*a*) that are used to used bolt or otherwise mechanically couple the housing attachment to the wood post mounting bracket (aP 13), as shown in FIGS. 27-30.

Figure 25:
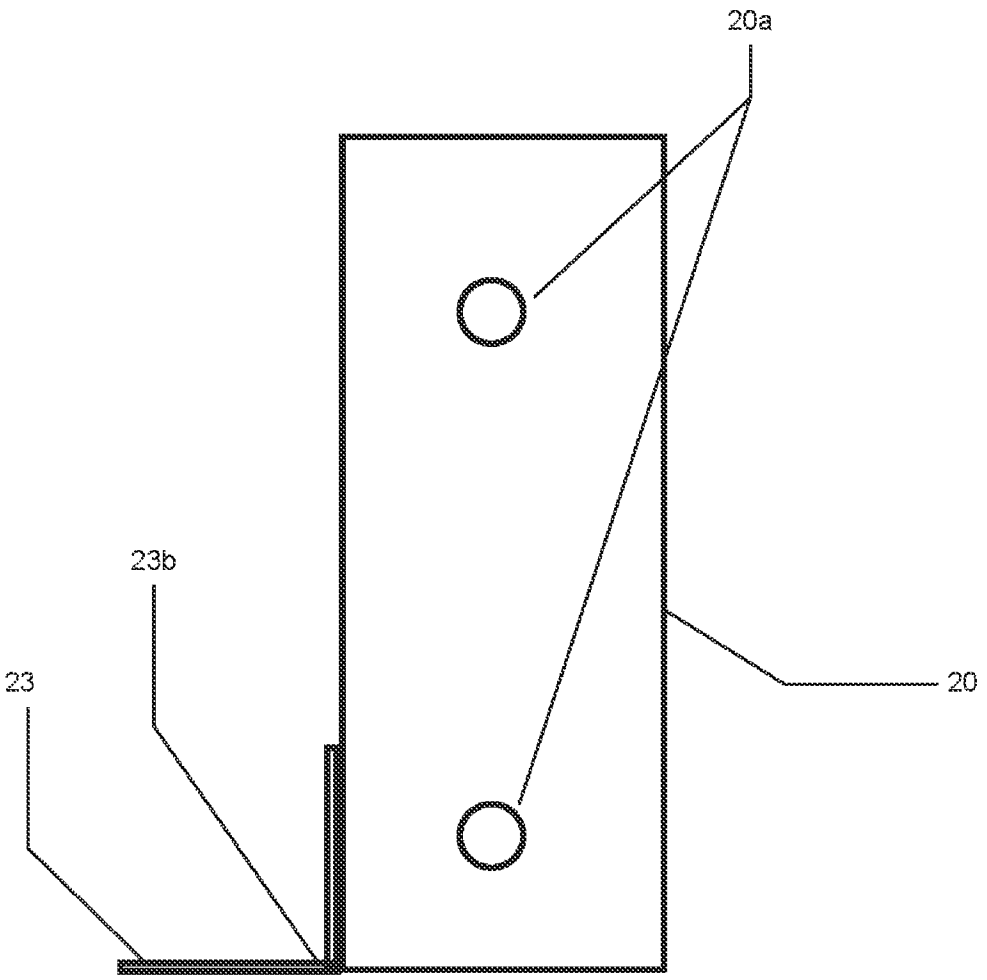
FIG. 25 depicts a side view Part 20 and Part 23 joined together to form a housing attachment for housing equipment.
Figure 26:
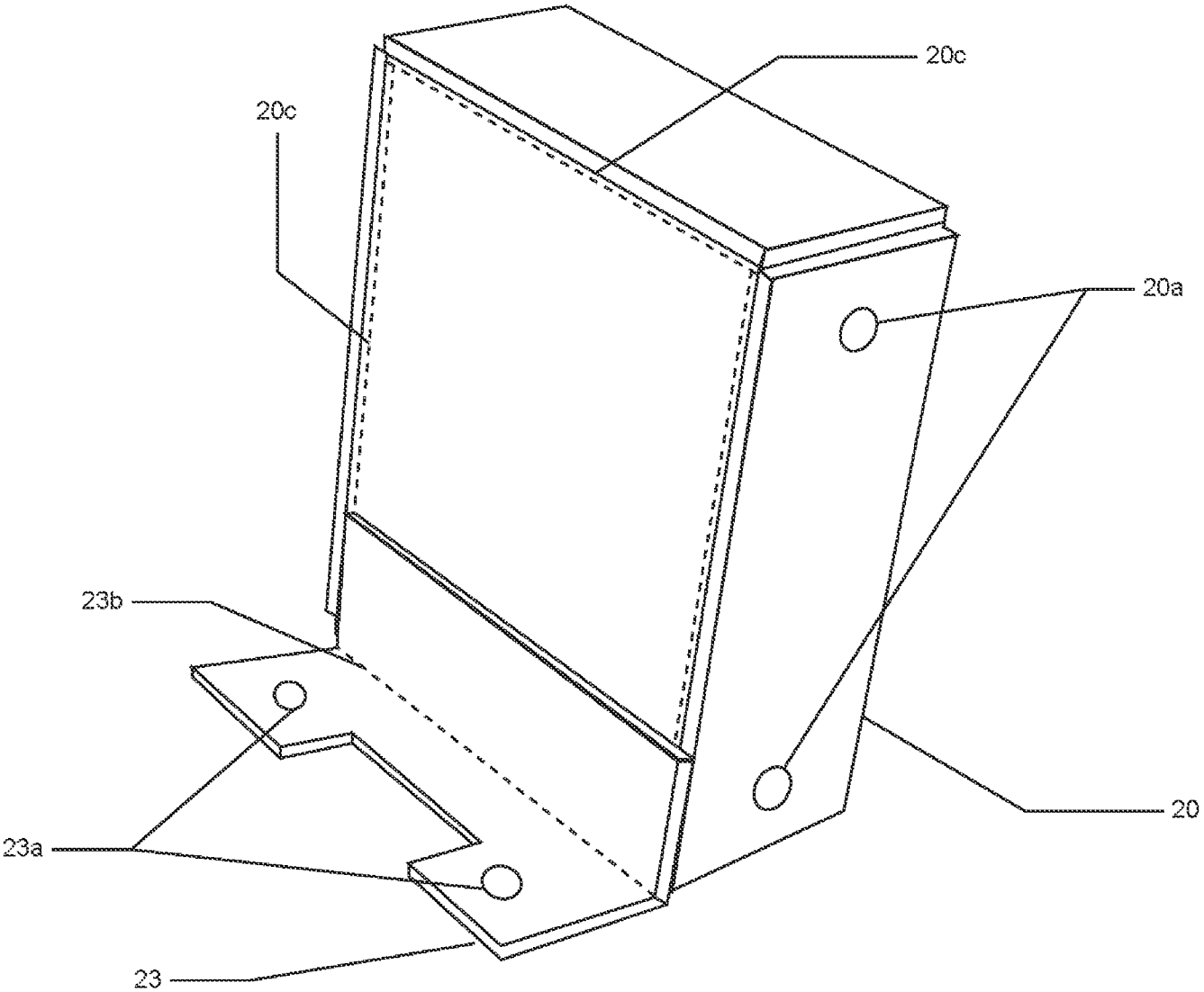
FIG. 26 depicts an isometric view of the housing attachment in FIG. 25.

Part 20 is in some forms welded (or otherwise affixed) to part 23, as shown in FIGS. 25 and 26, to form a housing attachment for safely housing electronic equipment or other important objects behind the shooting target that is added to the wood post mounting bracket. The electronic equipment in one form of the invention includes an electronic sensor for sensing and relaying positions on the target that are hit by projectiles.

Figure 31:
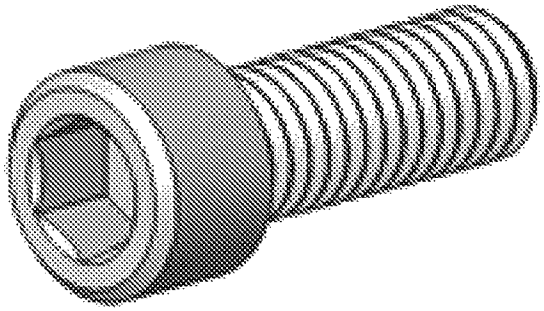
FIG. 31 depicts a view of Part 31.
Figure 32:
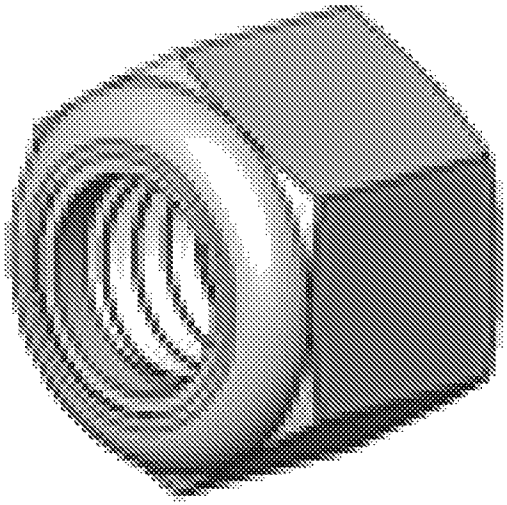
FIG. 32 depicts a view of Part 32.

Part 31 (shown in FIG. 31) is a cap screw for use with the Part 32 bolt (shown in FIG. 32). Parts 31 and 32 are used to secure the housing attachment to the wood mounting bracket at part 13, as shown in FIG. 27.

Figure 27:
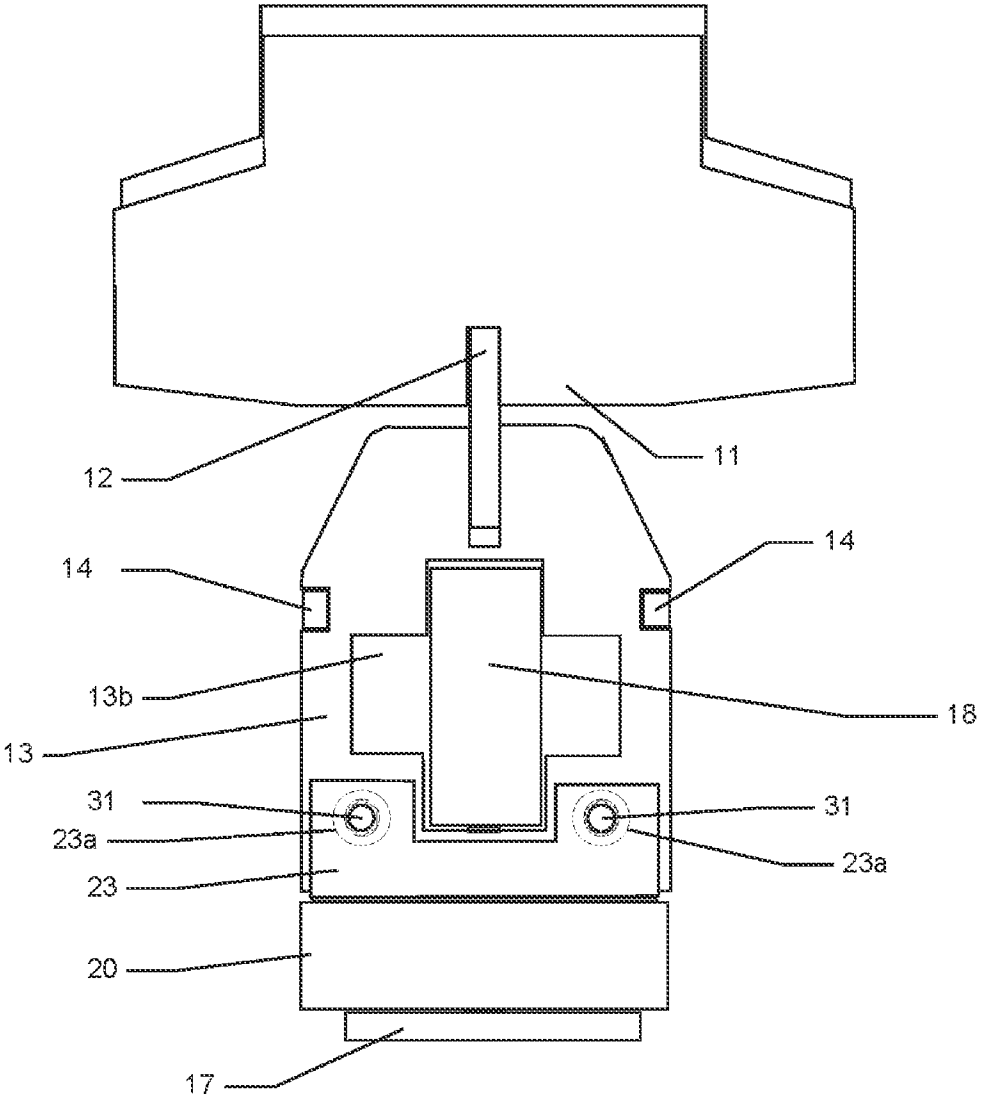
FIG. 27 depicts a top view of the housing attachment in FIG. 25.
Figure 28:
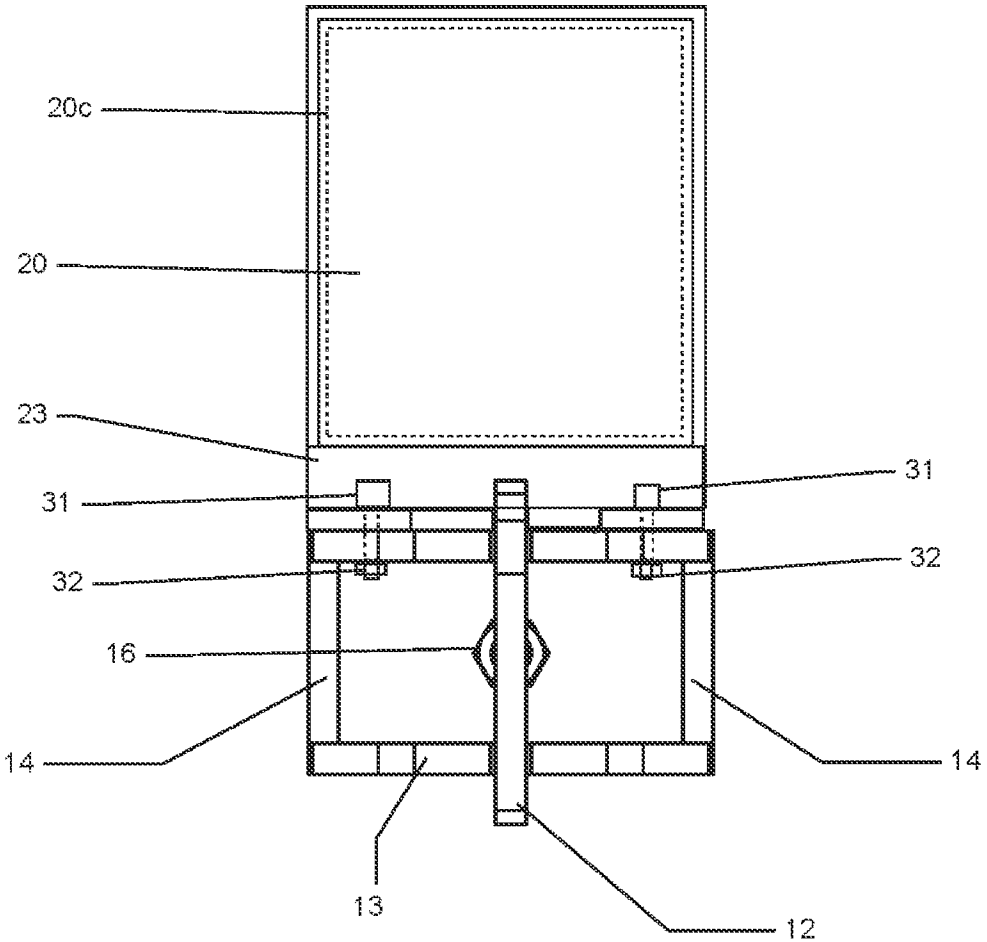
FIG. 28 depicts a front view of the housing attachment mounted to the bracket, without a target silhouette in place.
Figure 29:
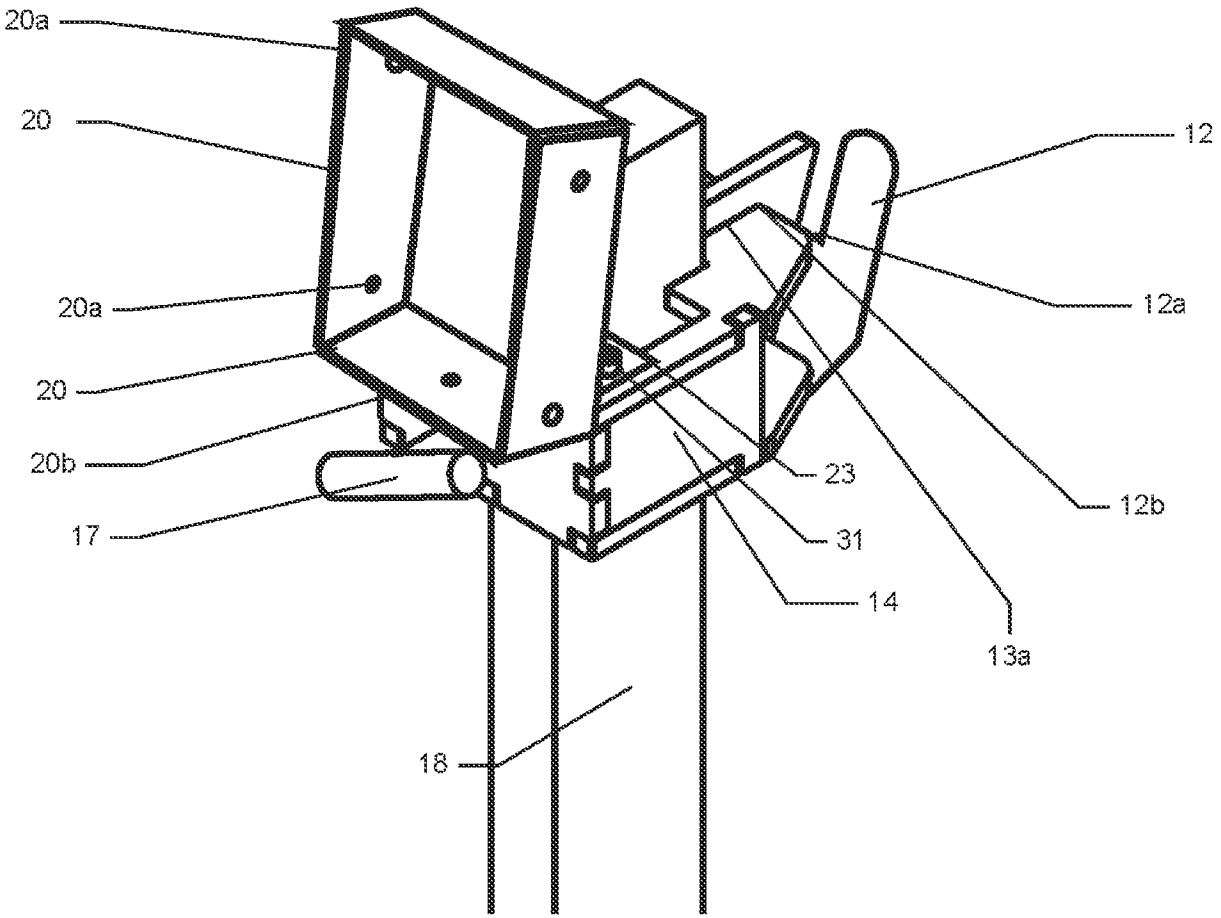
FIG. 29 depicts an isometric view of the housing attachment mounted to the bracket, which is mounted to a wood post, without a target silhouette in place.
Figure 30:
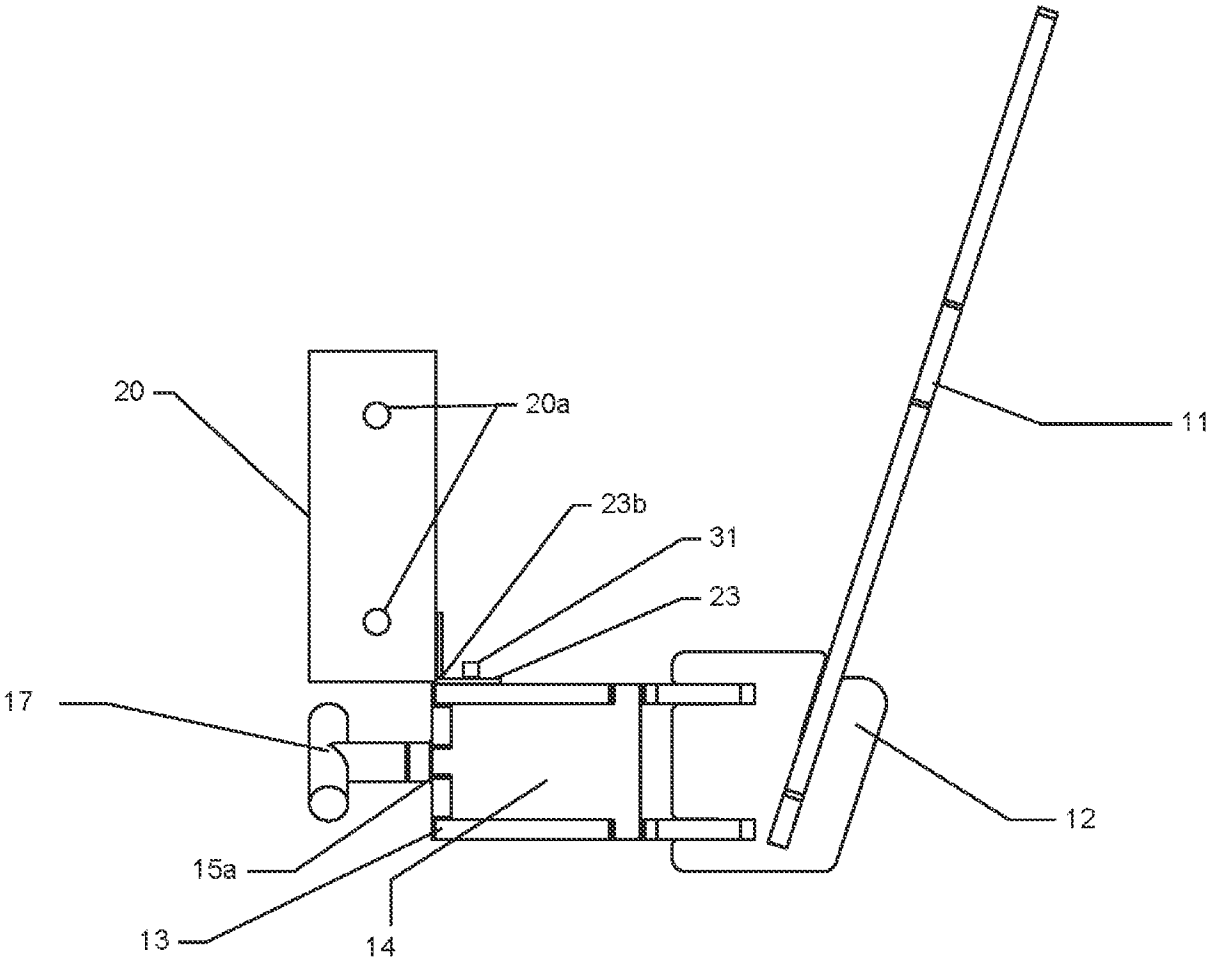
FIG. 30 depicts a side view of the housing attachment mounted to the bracket, with a target silhouette in place.

As shown in FIGS. 27 and 29, the housing attachment does not obstruct the wood mounting bracket from receiving and sliding on the wood post (18). FIG. 29 depicts the cavity or opening of Part 20 facing to the rear, so that the equipment is protected on the front side but accessible from the back side of the housing attachment.

Part 31. In some forms, Part 31 ranges in diameter from ⅜ inch to ½ inch, and ranges in length from 1 in to 2 inch FIG. 31 I made from hardened grade 8 steel.

Part 32:

In some forms, Part 32 ranges in thread diameter from ⅜ inch to ½ inch. In some forms, part 32 is made from steel and nylon for vibration resistance.

Part 31 is used in combination with Part 32 to mechanically attach the housing attachment to the wood mounting bracket. Mechanically attaching the housing attachment to the wood mounting bracket also allows for vibrations from the target being hit (which is also connected to the wood mounting bracket) to be felt by the attachment and the equipment inside of it.

Figure 33:
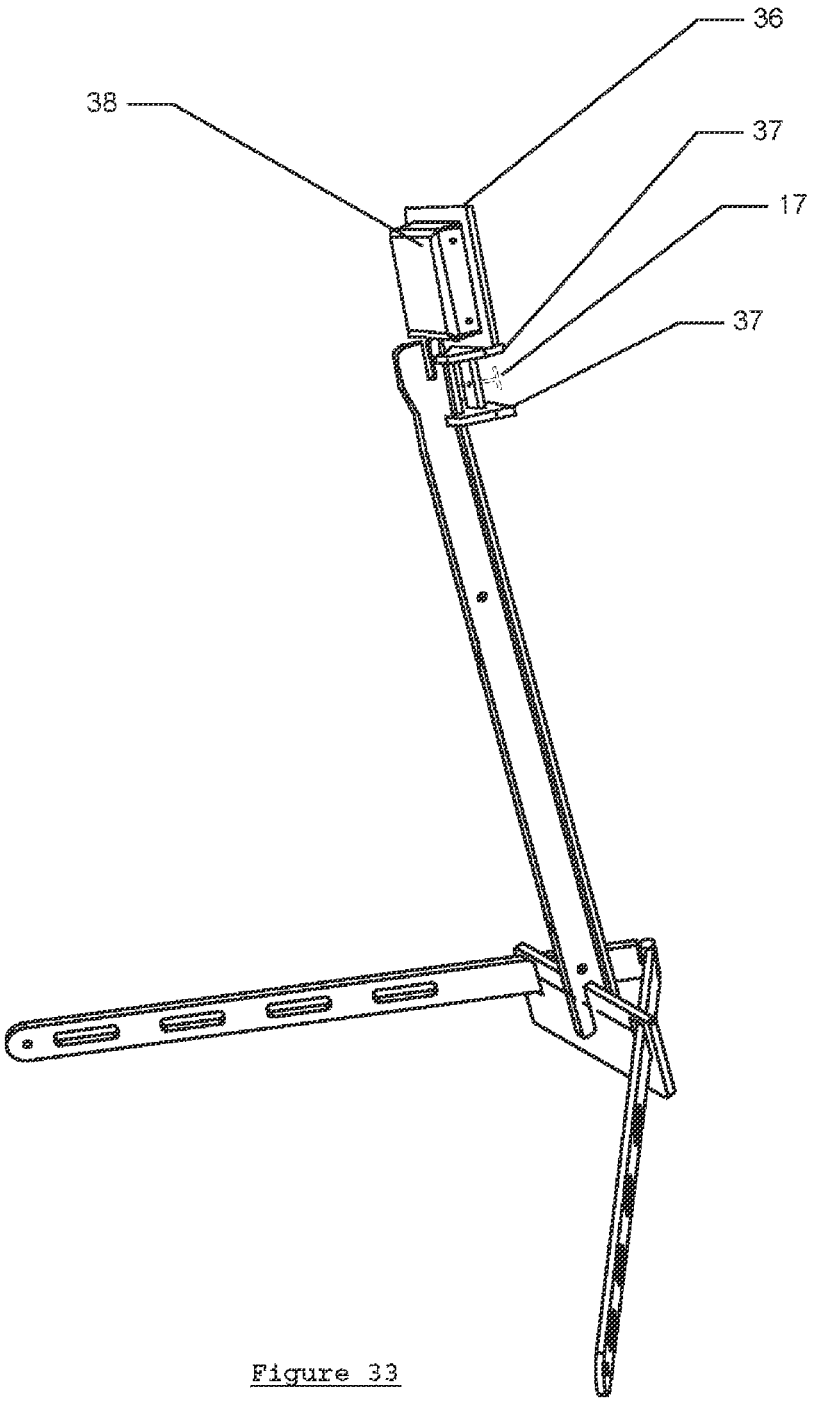
FIG. 33 depicts an isometric view of the steel target system disclosed in Provisional Application No. 62/528,751 with the housing attachment depicted in FIG. 38 attached.
Figure 34:
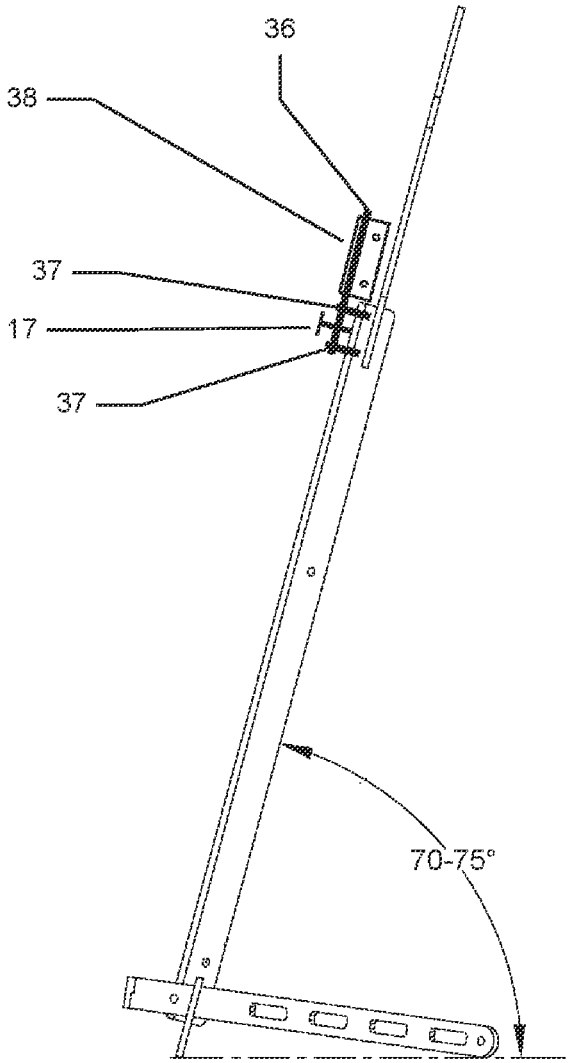
FIG. 34 depicts a side view of the steel target system disclosed in Provisional Application No. 62/528,751 with housing attachment depicted in FIG. 38 attached.
Figure 35:
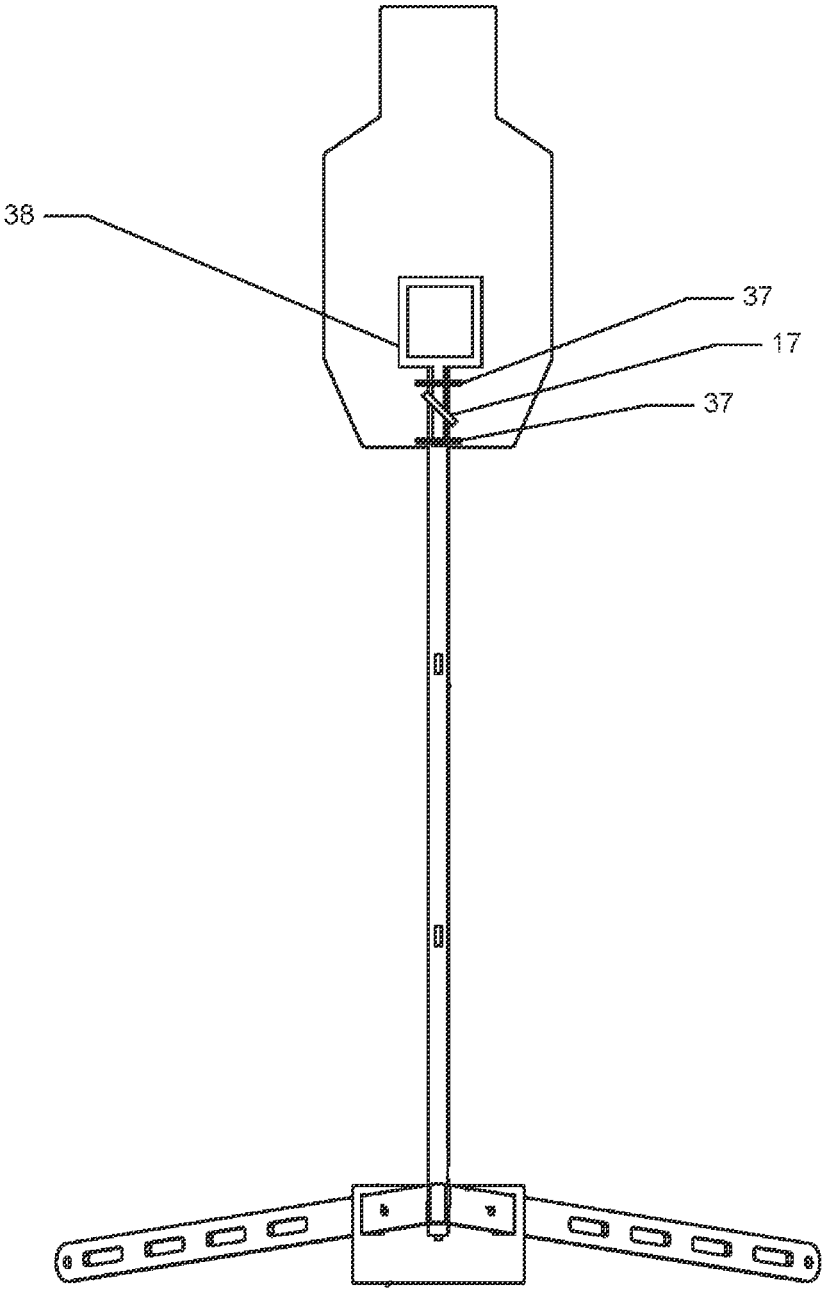
FIG. 35 depicts a rear view of the steel target system disclosed in Provisional Application No. 62/528,751 with the housing attachment depicted in FIG. 38 attached.
Figure 36:
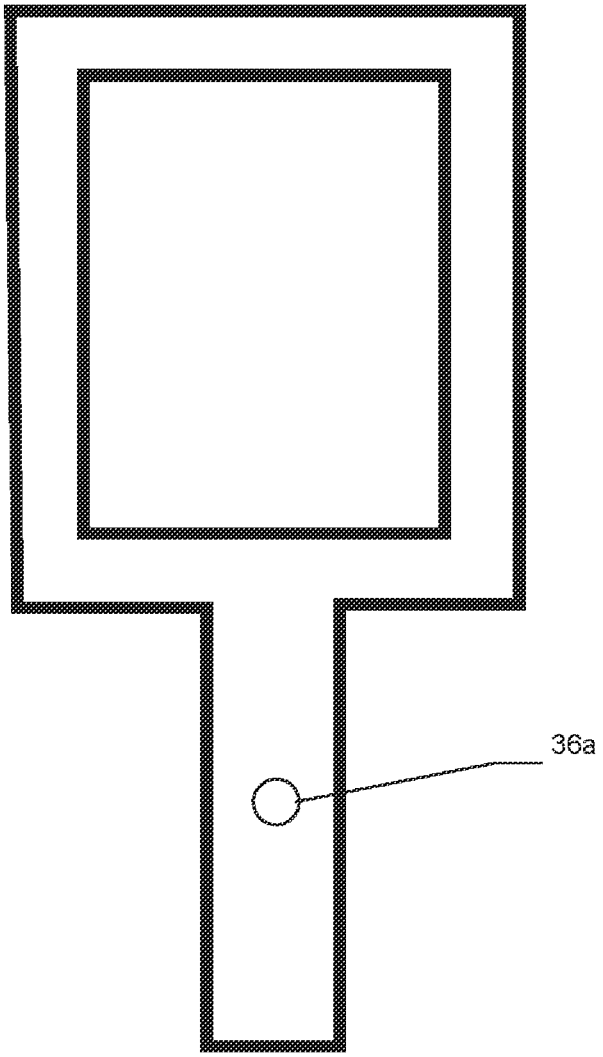
FIG. 36 depicts a view of Part 36.
Figure 37:
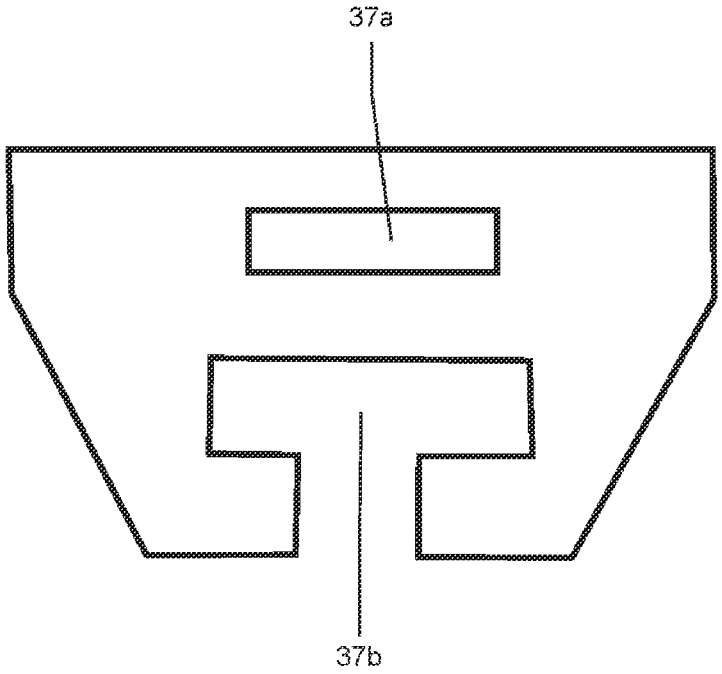
FIG. 37 depicts a view of Part 37.
Figure 38:
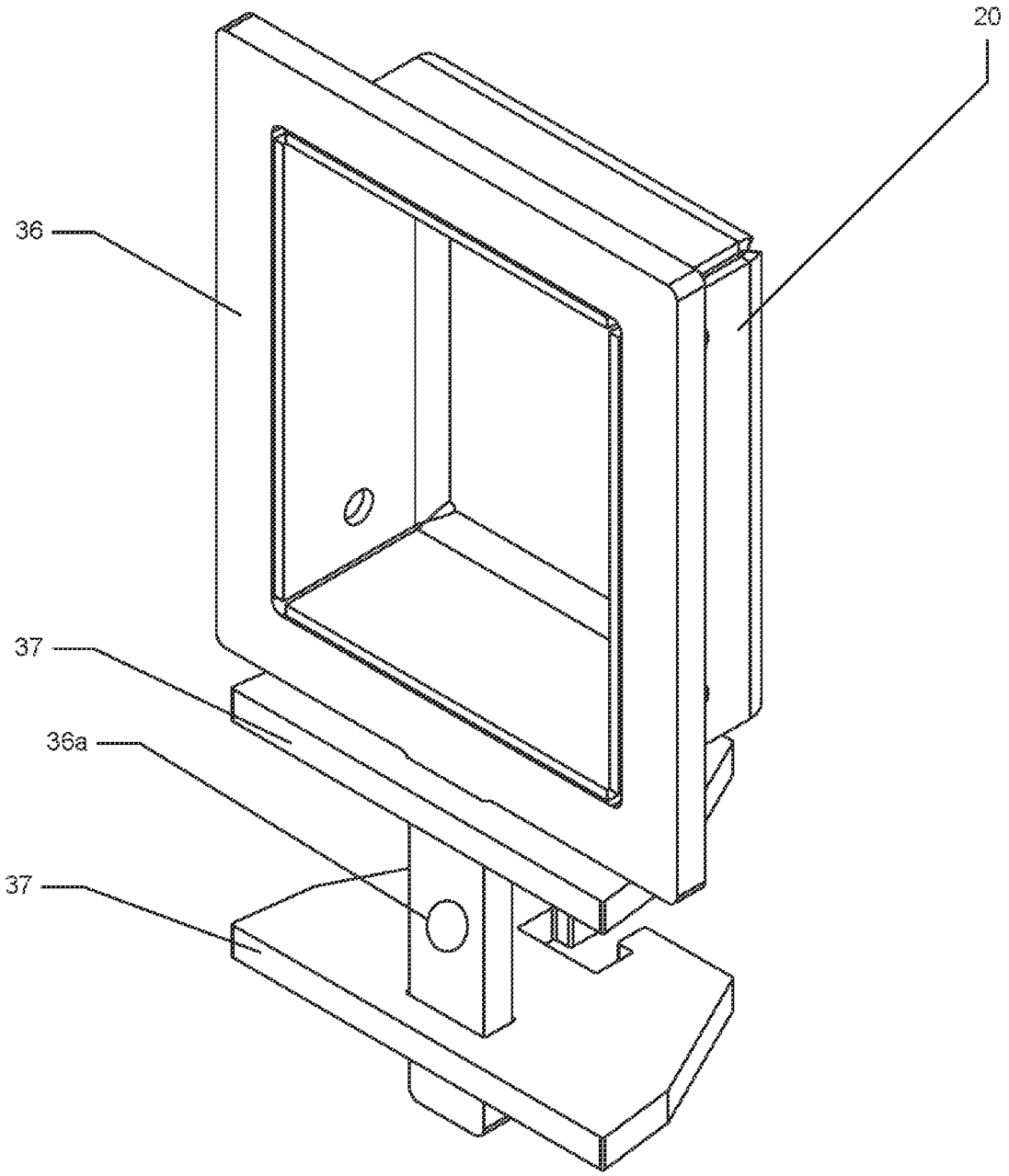
FIG. 38 depicts an isometric view of the assembled housing attachment for housing equipment that is used with the steel target system disclosed in Provisional Application No. 62/528,751.

Parts 36 and 37:

As shown in FIG. 38, two Parts 37, one Part 36, and one Part 20 are used to form a housing attachment (for safely housing electronic equipment or other important objects) that is compatible with steel target system disclosed in Provisional Application No. 62/528,751 (and U.S. patent Ser. No. 10/634,464). In this aspect of the invention, slot 37*a* fits receives Part 36, and the parts are secured together at the slot (typically by welding) to form the completed attachment 38 depicted in FIG. 38. Also Part 20 is secured (typically by welding) to Part 36. As shown in FIGS. 33 and 34, the attachment 38 fits over the post accessory rail through slots 37*b*, and the bottom portion of the box (Part 20) in attachment 38 sits on top of the steel post, in contact with the top of the steel post. Hole 36*a* may be threaded, or in one form, Part 16 will be welded to Part 36 at hole 36*a*. This will allow for Part 17 to be threaded through Part 36 at hole 36*a* and make contact with steel post to further secure Part 38 to the accessory rail and post by mechanical friction. Tightening Part 17 to the post also enables for more of the vibrations from the target (which is attached to the system) being hit to be felt by the attachment (for safely housing electronic equipment or other important objects) and the equipment inside of it. Part 20 in this form has two holes on the left side (20*a*) and two holes on the right side (20*a*). These holes are typically used to route electronic cords or wires from inside of the 5 sided shape Part 20 to the outside.

What is claimed is:

1. A bracket for a shooting target comprising:

a) a threaded hole on a back side of the bracket;

b) a post-receiving slot that extends through both a top and a bottom surface of the bracket to slide the bracket over a post with a rectangular cross-section having a long side and a short side, wherein:

a. the post-receiving slot enables the bracket to slide to a plurality of heights on the post;

b. the threaded hole is configured to receive a fastener that is configured to be tightened to contact the post, thereby locking the bracket at a desired height on the post; and c. when the fastener is loosened to break contact with the post, the bracket is configured to slide to a new desired height on the post; and c) a target-pairing plate extending from a front side of the bracket including a target-receiving slot configured to hold the shooting target at a downward angle relative to a vertical axis of the post-receiving slot wherein the post-receiving slot is a cross shape that forms a first rectangular slot perpendicular to a second rectangular slot, wherein the first slot is configured to receive the post in a first sliding configuration with the long side of the post parallel to the front side of the bracket and the second slot is configured to receive the post in a second sliding configuration with the long side of the post perpendicular to the front side of the bracket.

2. The bracket of claim 1, wherein the downward angle is 20 degrees.

3. The bracket of claim 1, wherein at least a portion of the bracket comprises AR-550 steel.

* * * * *